US010166773B2

(12) United States Patent
Kakiuchi

(10) Patent No.: US 10,166,773 B2
(45) Date of Patent: Jan. 1, 2019

(54) ACTUATOR DEVICE, CONNECTION STRUCTURE OF WIRE MEMBER, LIQUID EJECTOR, AND METHOD OF MANUFACTURING THE ACTUATOR DEVICE

(71) Applicant: BROTHER KOGYO KABUSHIKI KAISHA, Nagoya-shi, Aichi-ken (JP)

(72) Inventor: Toru Kakiuchi, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/470,496

(22) Filed: Mar. 27, 2017

(65) Prior Publication Data

US 2018/0086068 A1 Mar. 29, 2018

(30) Foreign Application Priority Data

Sep. 28, 2016 (JP) ..... 2016-189995

(51) Int. Cl.
*B41J 2/14* (2006.01)
*B41J 3/54* (2006.01)

(52) U.S. Cl.
CPC ..... *B41J 2/14201* (2013.01); *B41J 2/14048* (2013.01); *B41J 2/14072* (2013.01); *B41J 2/14233* (2013.01); *B41J 3/543* (2013.01); *B41J 2002/14435* (2013.01); *B41J 2002/14491* (2013.01); *B41J 2202/10* (2013.01); *B41J 2202/15* (2013.01); *B41J 2202/22* (2013.01)

(58) Field of Classification Search
CPC ..... B41J 2/14201; B41J 2/14072; B41J 2/14048; B41J 2/14233; B41J 2/14209; B41J 2/17526; B41J 2/17546; B41J 2/1753; B41J 3/543; B41J 2002/14491
See application file for complete search history.

(56) References Cited

U.S. PATENT DOCUMENTS

2006/0076158 A1 4/2006 Umeyama et al.
2012/0247816 A1 10/2012 Koide et al.
2012/0256988 A1* 10/2012 Gao ..... B41J 2/14233 347/50
2013/0187989 A1* 7/2013 Koseki ..... B41J 2/14209 347/71
2014/0232787 A1 8/2014 Owaki
2016/0291723 A1 10/2016 Kurasawa et al.
2017/0212620 A1 7/2017 Kurasawa et al.

FOREIGN PATENT DOCUMENTS

JP 2005-219238 A 8/2005
JP 2014-156065 A 8/2014

* cited by examiner

*Primary Examiner* — Juanita D Jackson
(74) *Attorney, Agent, or Firm* — Merchant & Gould P.C.

(57) ABSTRACT

An actuator device includes: an actuator including a first element contact; and a wire member including (a) a first contact connected to the first element contact and (b) a first wire configured to conduct with the first contact. A first wide portion is formed at a distal end portion of the first wire at an edge portion of the wire member. The first wide portion is disposed beyond the first element contact in a wire direction of the first wire. The first contact is disposed at a basal end portion of the first wire. The basal end portion is located further from the edge portion of the wire member than the first wide portion. The first contact is connected to the first element contact.

22 Claims, 17 Drawing Sheets

ACTUATOR DEVICE, CONNECTION STRUCTURE OF WIRE MEMBER, LIQUID EJECTOR, AND METHOD OF MANUFACTURING THE ACTUATOR DEVICE

CROSS REFERENCE TO RELATED APPLICATION

The present application claims priority from Japanese Patent Application No. 2016-189995, which was filed on Sep. 28, 2016, the disclosure of which is herein incorporated by reference in its entirety.

BACKGROUND

The following disclosure relates to an actuator device, a connection structure of a wire member, a liquid ejector, and a method of manufacturing the actuator device.

There is known a liquid ejector including: a passage definer having pressure chambers respectively communicating with nozzles; and a piezoelectric actuator configured to apply ejection energy to ink in the pressure chambers.

The piezoelectric actuator includes piezoelectric elements respectively corresponding to the pressure chambers. Contacts are respectively drawn out from individual electrodes of the respective piezoelectric elements. A flexible wire member (a COD on which drive circuits are mounted) is joined to a portion of the piezoelectric actuator at which the contacts of the piezoelectric elements are arranged. The contacts of the piezoelectric actuator and the contacts of the wire member are electrically connected to each other at this joint portion.

SUMMARY

Common flexible wire members are configured such that a multiplicity of wires are patterned on an insulated substrate (e.g., base film) formed of polyimide, for example. Some manufactures of the wire members include a step of cutting the substrate so as to separate each wire after the wires are formed on the substrate. In this case, the wires may be crushed at an area where the substrate is cut, so that the wires may respectively have wide portions having a larger wire width at an edge portion of the substrate formed by cutting.

In the case where the wide portions of the wires are formed at the edge portion of the substrate, the larger wire width reduces a distance between the wire and another adjacent wire or a conductive pattern. This reduced distance increases a possibility of occurrence of shorts between the wire having the wide portion and another adjacent wire when the edge portion of the substrate is joined to the actuator.

Accordingly, an aspect of the disclosure relates to a technique for preventing occurrences of shorts between (i) a wire having a wide portion at an edge portion of a wire member and (ii) another wire or the like located adjacent to the wire having the wide portion.

In one aspect of the disclosure, an actuator device includes: an actuator including at least one drive element and at least one first element contact respectively drawn from the at least one drive element; and a wire member including (a) at least one first contact respectively connected to the at least one first element contact and (b) at least one first wire configured to respectively conduct with the at least one first contact. Each of the at least one first wire includes a distal end portion disposed at an edge portion of the wire member. A first wide portion is formed at the distal end portion. The first wide portion has a wire width greater than that of a portion of said each of the at least one first wire other than the distal end portion thereof. The first wide portion of each of the at least one first wire is disposed beyond a corresponding one of the at least one first element contact in a wire direction in which said each of the at least one first wire extends, in a state in which the actuator and the wire member are joined to each other. Each of the at least one first contact is disposed at a basal end portion of a corresponding one of the at least one first wire. The basal end portion is located further from the edge portion of the wire member than the first wide portion. Each of the at least one first contact is connected to a corresponding one of the at least one first element contact.

Another aspect of the disclosure relates to a connection structure of a wire member configured to connect at least one first element contact and at least one first contact to each other. The at least one first contact is configured to respectively conduct with at least one first wire of the wire member. Each of the at least one first wire includes a distal end portion disposed at an edge portion of the wire member. A first wide portion is formed at the distal end portion. The first wide portion has a wire width greater than that of a portion of said each of the at least one first wire other than the distal end portion thereof. The first wide portion of each of the at least one first wire is disposed beyond a corresponding one of the at least one first element contact in a wire direction in which said each of the at least one first wire extends, in a state in which the at least one first element contact and the at least one first contact are respectively joined to each other. Each of the at least one first contact is disposed at a basal end portion of a corresponding one of the at least one first wire. The basal end portion is located further from the edge portion of the wire member than the first wide portion. Each of the at least one first contact is connected to a corresponding one of the at least one first element contact.

In another aspect of the disclosure, a liquid ejector includes: a passage definer defining therein at least one pressure chamber; an actuator including (i) at least one piezoelectric element disposed on the passage definer so as to overlap the at least one pressure chamber and (ii) at least one first element contact drawn from the at least one piezoelectric element; and a wire member including (a) at least one first contact respectively connected to the at least one first element contact and (b) at least one first wire configured to respectively conduct with the at least one first contact. Each of the at least one first wire includes a distal end portion disposed at an edge portion of the wire member. A first wide portion is formed at the distal end portion. The first wide portion has a wire width greater than that of a portion of said each of the at least one first wire other than the distal end portion thereof. The first wide portion of each of the at least one first wire is disposed beyond a corresponding one of the at least one first element contact in a wire direction in which said each of the at least one first wire extends, in a state in which the actuator and the wire member are joined to each other. Each of the at least one first contact is disposed at a basal end portion of a corresponding one of the at least one first wire. The basal end portion is located further from the edge portion of the wire member than the first wide portion. Each of the at least one first contact is connected to a corresponding one of the at least one first element contact.

In another aspect of the disclosure, a method of manufacturing an actuator device includes: a wire forming step of forming at least one first wire and at least one test contact on a base of a wire member, the at least one test contact being respectively connected to the at least one first wire; a testing step of performing a conduction test of the at least one first wire using the at least one test contact; a cutting step of cutting the base along an area between the at least one first wire and the at least one test contact after the testing step; and a joining step of joining the wire member to the actuator in a state in which a portion of each of the at least one first wire which is further from a cut edge of the base than a first wide portion formed in the cutting step overlaps the at least one first element contact of the actuator.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIGS. 8A and 8B are enlarged views of a chip-on-film (COF), wherein FIG. 8A illustrates a surface of the COF which is located an opposite side of the COF from its surface on which the wires are arranged, and FIG. 8B illustrates the surface of the COF on which the wires are arranged;

DETAILED DESCRIPTION OF THE EMBODIMENT

Figure 1:
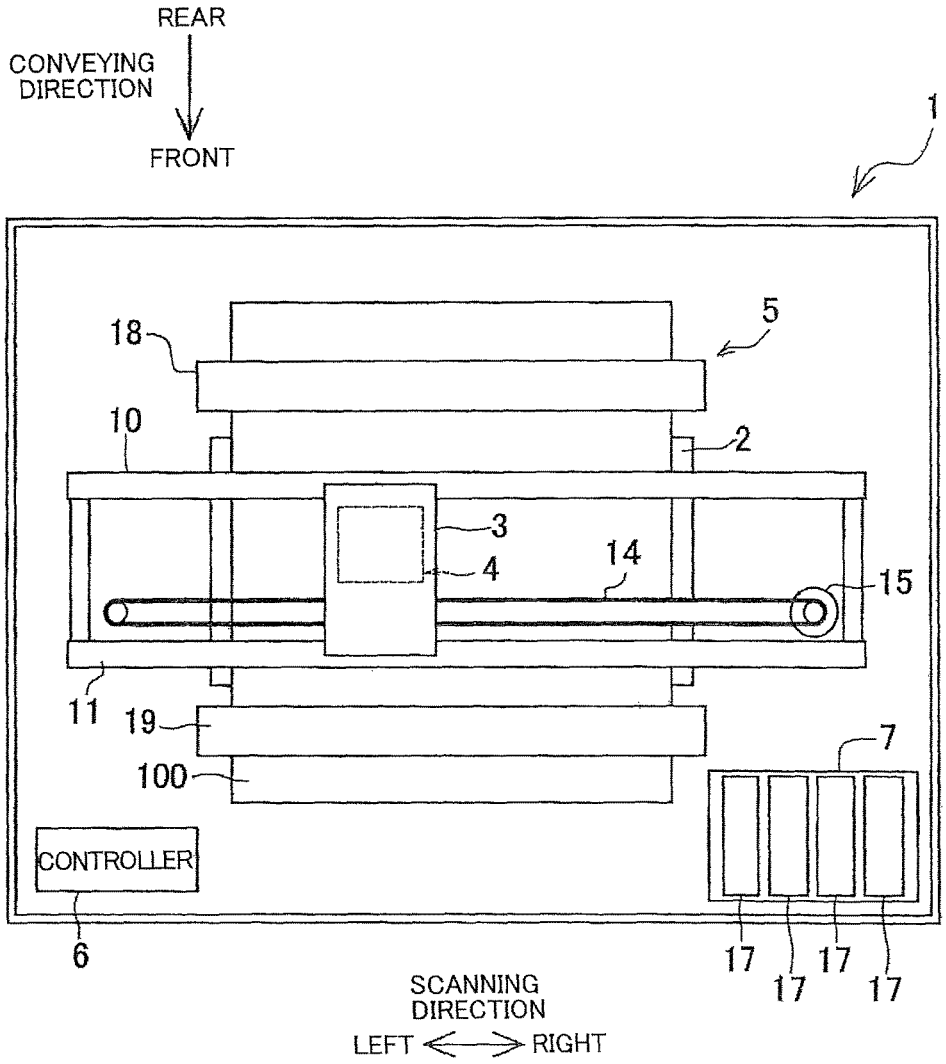
FIG. 1 is a schematic plan view of a printer according to the present embodiment.

Hereinafter, there will be described an embodiment by reference to the drawings. First, there will be explained an overall configuration of an ink-jet printer 1 with reference to FIG. 1. The direction in which a recording sheet 100 is conveyed in FIG. 1 is defined as the front and rear direction of the printer 1. The widthwise direction of the recording sheet 100 is defined as the right and left direction of the printer 1. The direction orthogonal to the front and rear direction and the right and left direction and perpendicular to the sheet surface of FIG. 1 is defined as the up and down direction of the printer 1.

Overall Configuration of Printer

As illustrated in FIG. 1, the ink-jet printer 1 includes a carriage 3, an ink-jet head 4, a conveying mechanism 5, and a controller 6.

The carriage 3 is mounted on guide rails 10, 11 extending in the right and left direction (hereinafter may also be referred to as "scanning direction"). The carriage 3 is joined to a carriage driving motor 15 via an endless belt 14. The carriage 3 is driven by the motor 15 and reciprocated in the scanning direction over the recording sheet 100 conveyed on a platen 2.

The ink-jet head 4 is mounted on the carriage 3. Inks of four colors, namely, black, yellow, cyan, and magenta, are supplied to the ink-jet head 4 respectively via tubes, not illustrated, from four ink cartridges 17 held by a holder 7. While moving in the scanning direction with the carriage 3, the ink-jet head 4 ejects the inks from a multiplicity of nozzles 24 (see FIGS. 2-6) onto the recording sheet 100 conveyed on the platen 2.

The conveying mechanism 5 includes two conveying rollers 18, 19 configured to convey the recording sheet 100 on the platen 2 in the front direction (hereinafter may also be referred to as "conveying direction").

The controller 6 controls devices including the ink-jet head 4 and the carriage driving motor 15 to print an image on the recording sheet 100 based on a print instruction received from an external device such as a personal computer (PC).

Detailed Configuration of Ink-Jet Head

There will be next explained a configuration of the ink-jet head 4 with reference to FIGS. 2-6. It is noted that FIGS. 3 and 4 omit illustration of a protector 23 illustrated in FIG. 2.

In the present embodiment, the ink-jet head 4 ejects the inks of the four colors (black, yellow, cyan, and magenta). As illustrated in FIGS. 2-6, the ink-jet head 4 includes a nozzle plate 20, a passage definer 21, and an actuator device 25 including a piezoelectric actuator 22. In the present embodiment, the actuator device 25 does not indicate only the piezoelectric actuator 22 but includes not only the piezoelectric actuator 22 but also the protector 23 and chip-on-films (COFs) 50 disposed on the piezoelectric actuator 22. Each of the COFs 50 is one example of a wire member.

Nozzle Plate

The nozzle plate 20 is formed of silicon, for example. The nozzle plate 20 has the nozzles 24 arranged in the conveying direction.

Figure 2:
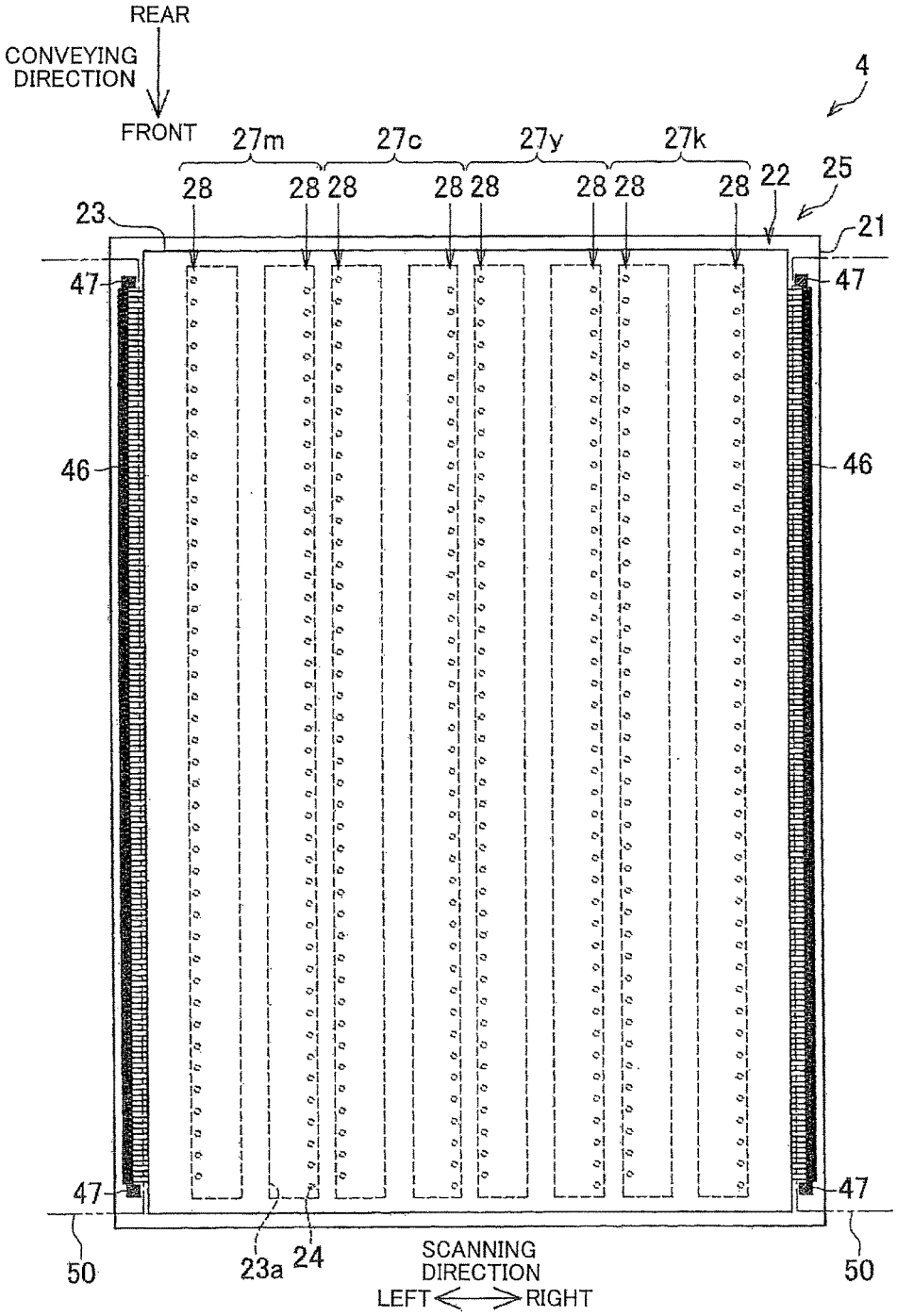
FIG. 2 is a plan view of an ink-jet head.
Figure 3:
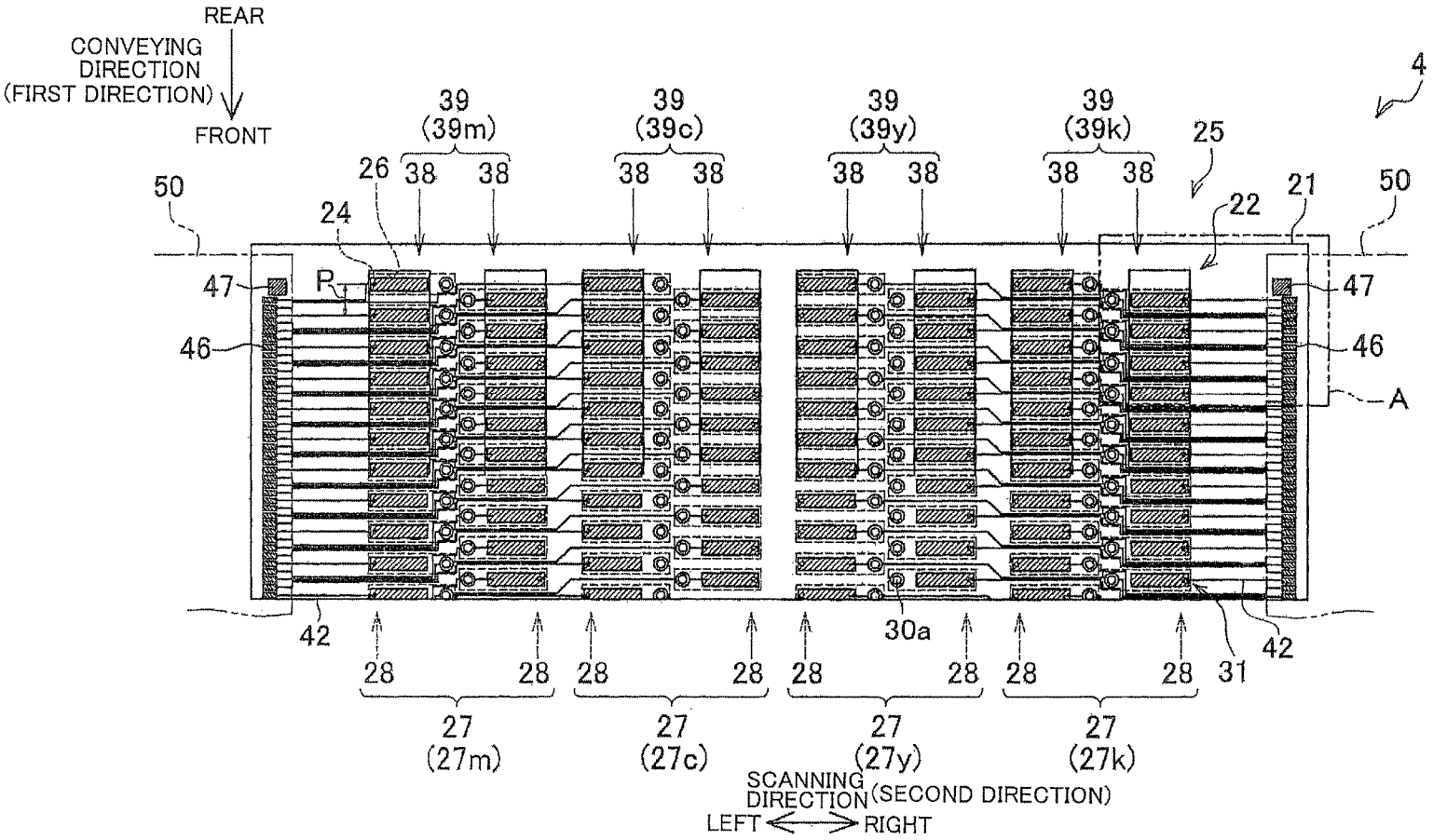
FIG. 3 is an enlarged view of a rear end portion of the ink-jet head in FIG. 2.

More specifically, as illustrated in FIGS. 2 and 3, the nozzle plate 20 has four nozzle groups 27 arranged in the scanning direction. The four nozzle groups 27 are for ejection of the different inks, respectively. Each of the nozzle groups 27 is constituted by right and left nozzle rows 28. In each of the nozzle rows 28, the nozzles 24 are arranged at intervals P. Positions of the nozzles 24 are displaced by P/2 in the conveying direction between the two nozzle rows 28. That is, the nozzles 24 are arranged in two rows in a staggered configuration in each nozzle group 27.

In the following explanation, one of suffixes k, y, c, and m may be selectively added to the reference numbers of components of the ink-jet head 4 to indicate their respective correspondences with one of the black, yellow, cyan, and magenta inks. For example, the wording "nozzle groups 27*k*" indicates the nozzle group 27 for the black ink.

Passage Definer

The passage definer 21 is a base plate formed of silicon single crystal. As illustrated in FIGS. 3-6, the passage definer 21 has pressure chambers 26 communicating with the respective nozzles 24. Each of the pressure chambers 26 has a rectangular shape elongated in the scanning direction in plan view. The pressure chambers 26 are arranged in the conveying direction so as to correspond to the arrangement of the nozzles 24. The pressure chambers 26 are arranged in eight pressure chamber rows, each two of which correspond to one of the four ink colors. A lower surface of the passage definer 21 is covered with the nozzle plate 20. An outer end portion of each of the pressure chambers 26 in the scanning direction overlaps a corresponding one of the nozzles 24.

A vibration layer 30 of the piezoelectric actuator 22, which will be described below, is disposed on an upper surface of the passage definer 21 so as to cover the pressure chambers 26. The vibration layer 30 is not limited in particular as long as the vibration layer 30 is an insulating layer covering the pressure chambers 26. In the present embodiment, the vibration layer 30 is formed by oxidation or nitriding of a surface of the base plate formed of silicon. The vibration layer 30 has ink supply holes 30*a* at areas each covering an end portion of a corresponding one of the pressure chambers 26 in the scanning direction (which end portion is located on an opposite side of the pressure chamber 26 from the nozzle 24).

For each ink color, the ink is supplied from a corresponding one of four reservoirs 23*b* formed in the protector 23, which will be described below, to the pressure chambers 26 through the respective ink supply holes 30*a*. When ejection energy is applied to the ink in each of the pressure chambers 26 by a corresponding one of piezoelectric elements 31 of the piezoelectric actuator 22 which will be described below, an ink droplet is ejected from the nozzle 24 communicating with the pressure chamber 26.

Actuator Device

The actuator device 25 is disposed on the upper surface of the passage definer 21. The actuator device 25 includes: the piezoelectric actuator 22 including the piezoelectric elements 31; the protector 23; and the two COFs 50.

Figure 4:
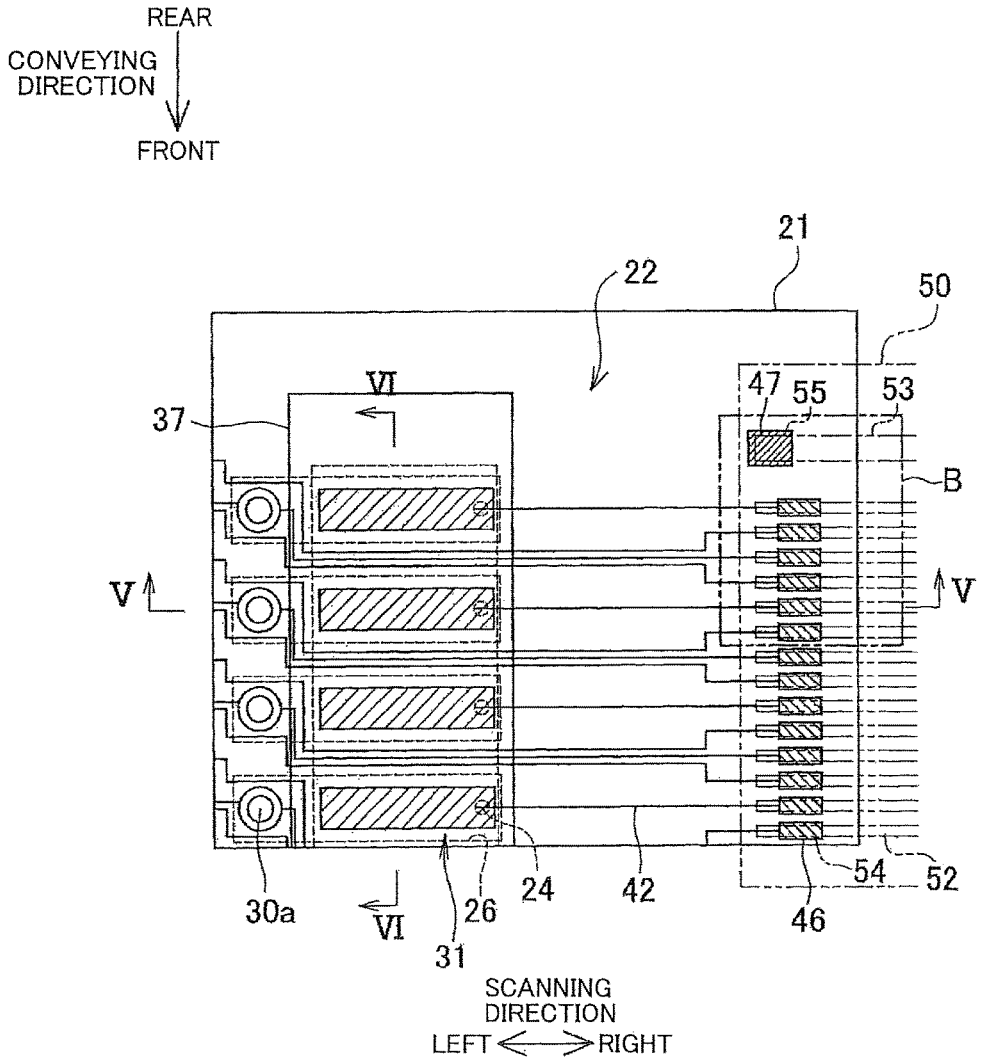
FIG. 4 is an enlarged view of an area A in FIG. 3.

The piezoelectric actuator 22 is disposed on the entire upper surface of the passage definer 21. As illustrated in FIGS. 3 and 4, the piezoelectric actuator 22 includes the piezoelectric elements 31 arranged so as to overlap the respective pressure chambers 26. The piezoelectric elements 31 are arranged in the conveying direction so as to correspond to the arrangement of the pressure chambers 26 and constitute eight piezoelectric element rows 38. A plurality of driving contacts 46 and two ground contacts 47 are drawn out leftward from left four of the piezoelectric element rows 38, and as illustrated in FIGS. 2 and 3 the contacts 46, 47 are disposed on a left end portion of the passage definer 21. A plurality of driving contacts 46 and two ground contacts 47 are drawn out rightward from right four of the piezoelectric element rows 38, and the contacts 46, 47 are disposed on a right end portion of the passage definer 21. The structure of the piezoelectric actuator 22 will be described below in detail.

The protector 23 is disposed on an upper surface of the piezoelectric actuator 22 so as to cover the piezoelectric elements 31. Specifically, the protector 23 includes eight recessed protecting portions 23*a* respectively covering the eight piezoelectric element rows 38. As illustrated in FIG. 2, the protector 23 does not cover right and left end portions of the piezoelectric actuator 22, so that the driving contacts 46 and the ground contacts 47 are exposed from the protector 23. The protector 23 has the reservoirs 23*b* connected to the respective ink cartridges 17 held by the holder 7. The ink in each of the reservoirs 23*b* is supplied to the pressure chambers 26 through respective ink supply passages 23*c* and the respective ink supply holes 30*a* formed in the vibration layer 30.

Each of the COFs 50 illustrated in FIGS. 2-5 is a flexible wire (lead) member including a base 56 formed of insulating material such as a polyimide film. A driver IC 51 is mounted on the base 56. One end portions of the respective two COFs 50 are connected to the controller 6 (see FIG. 1) of the printer 1. The other end portions of the respective two COFs 50 are respectively joined to right and left end portions of the piezoelectric actuator 22. As illustrated in FIG. 4, each of the COFs 50 includes ground wires 53 and a plurality of individual wires 52 connected to the respective driver ICs 51. Each of the individual wires 52 is connected to a corresponding one of the driving contacts 46 of the piezoelectric actuator 22 at a corresponding one of individual contacts 54. Likewise, each of the ground wires 53 is connected to a corresponding one of the ground contacts 47 of the piezoelectric actuator 22 at a corresponding one of ground contacts 55. Each of the driver ICs 51 outputs a drive signal to a corresponding one of the piezoelectric elements 31 of the piezoelectric actuator 22 via a corresponding one of the individual contacts 54 and a corresponding one of the driving contacts 46. While the two ground contacts 47 are provided for each of the COFs 50 in the present embodiment, the following explanation will be given for one of the ground contacts 47 for simplicity unless otherwise required.

Detailed Structure of Piezoelectric Actuator

The piezoelectric actuator 22 includes: the vibration layer 30 formed on the upper surface of the passage definer 21; and the piezoelectric elements 31 disposed on an upper surface of the vibration layer 30. For simplicity, FIGS. 3 and 4 omit illustration of a protecting layer 40, an insulating layer 41, and a wire protecting layer 43 illustrated in FIGS. 5 and 6.

As illustrated in FIGS. 3-6, the piezoelectric elements 31 are arranged on the upper surface of the vibration layer 30 so as to overlap the respective pressure chambers 26. That is, the piezoelectric elements 31 are arranged in the conveying direction so as to correspond to the arrangement of the pressure chambers 26. As a result, in accordance with the arrangement of the nozzles 24 and the pressure chambers 26, the piezoelectric elements 31 constitute the eight piezoelectric element rows 38, each two of which correspond to one of the four ink colors. It is noted that a group of the piezoelectric elements 31 of the two piezoelectric element rows 38 corresponding to each of the four ink colors will be referred to as "piezoelectric element group 39". As illustrated in FIG. 3, the four piezoelectric element groups 39*k*, 39*y*, 39*c*, 39*m* respectively corresponding to the four ink colors are arranged in the scanning direction.

Each of the piezoelectric elements 31 includes a first electrode 32, a piezoelectric layer 33, and a second electrode 34 disposed in this order from a lower side over the vibration layer 30.

Figure 5:
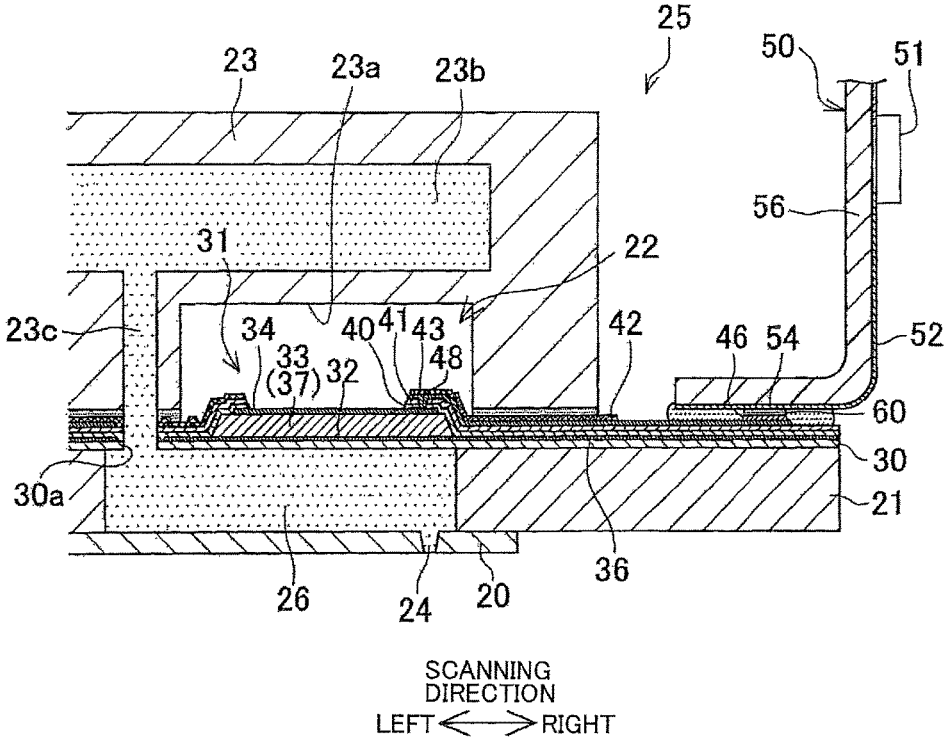
FIG. 5 is a cross-sectional view taken along line V-V in FIG. 4.
Figure 6:
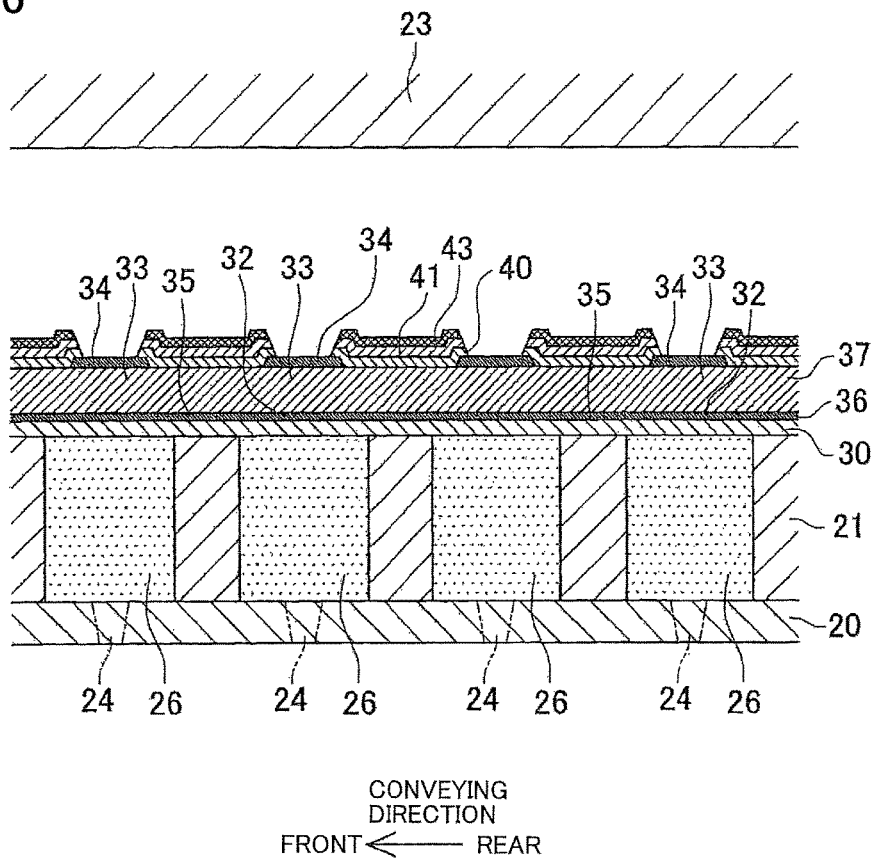
FIG. 6 is a cross-sectional view taken along line VI-VI in FIG. 4.

As illustrated in FIGS. 5 and 6, the first electrode 32 is formed at an area opposed to the pressure chamber 26 formed in the vibration layer 30. As illustrated in FIG. 6, each adjacent two of the first electrodes 32 of the respective piezoelectric elements 31 are connected to each other by an electrically conductive portion 35 disposed between the piezoelectric elements 31. In other words, the first electrodes 32 and the electrically conductive portions 35 connecting the first electrodes 32 to each other constitute a common electrode 36 that covers substantially the entire upper surface of the vibration layer 30. The common electrode 36 is formed of platinum (Pt), for example. The thickness of the common electrode 36 is 0.1 μm, for example. It is noted that the wording "conduct" and "conductive" in the present specification principally means "electrically conduct" and "electrically conductive".

The piezoelectric layer 33 is formed of a piezoelectric material such as lead zirconate titanate (PZT), for example. The piezoelectric layer 33 may be formed of a non-lead piezoelectric material not containing lead. The thickness of the piezoelectric layer 33 is ranged between 1.0 μm and 2.0 μm, for example.

As illustrated in FIGS. 3, 4, and 6, in the present embodiment, the piezoelectric layers 33 of the respective piezoelectric elements 31 are connected to each other in the conveying direction to form a rectangular piezoelectric member 37 elongated in the conveying direction. That is, the eight piezoelectric members 37 constituted by the piezoelectric layers 33 respectively corresponding to the eight pressure chamber rows are disposed on the common electrode 36 covering the vibration layer 30.

The second electrodes 34 are disposed on upper surfaces of the respective piezoelectric layers 33. Each of the second electrodes 34 has a rectangular shape in plan view which is one size smaller than each of the pressure chambers 26. The second electrodes 34 respectively overlap central portions of the respective pressure chambers 26. Unlike the first electrodes 32, the second electrodes 34 of the respective piezoelectric elements 31 are separated and spaced apart from each other. That is, the second electrodes 34 are individual electrodes provided for individually for the respective piezoelectric elements 31. The second electrodes 34 are formed of iridium (Ir) or platinum (Pt), for example. The thickness of each of the second electrodes 34 is 0.1 μm, for example.

As illustrated in FIGS. 5 and 6, the piezoelectric actuator 22 includes the protecting layer 40, the insulating layer 41, driving wires 42, and the wire protecting layer 43.

As illustrated in FIG. 5, the protecting layer 40 is disposed so as to cover a surface of the piezoelectric member 37 except central portions of the respective second electrodes 34. One of main purposes of the protecting layer 40 is preventing ingress of water from air into the piezoelectric layers 33. The protecting layer 40 is formed of a material having low permeability such as oxides and nitrides, for example. Examples of the oxides include alumina ($Al_2O_3$), silicon oxide (SiOx), and tantalum oxide (TaOx). Examples of the nitrides include silicon nitride (SiN).

The insulating layer 41 is formed on an upper side of the protecting layer 40. A material of the insulating layer 41 is not limited in particular. For example, the insulating layer 41 is formed of silicon dioxide ($SiO_2$). This insulating layer 41 is provided for increasing insulation between the common electrode 36 and the driving wires 42 connected to the respective second electrodes 34.

The driving wires 42 are formed on the insulating layer 41. The driving wires 42 are drawn out from the respective second electrodes 34 of the piezoelectric elements 31. Each of the driving wires 42 is formed of aluminum (Al), for example. As illustrated in FIG. 5, one end portion of each of the driving wires 42 is disposed so as to overlap an end portion of the second electrode 34 disposed on a corresponding one of the piezoelectric layers 33. Each of the driving wires 42 is conductive with the corresponding second electrode 34 by a through electrically-conductive portion 48 that extends through the protecting layer 40 and the insulating layer 41.

Each of the driving wires 42 corresponding to the respective piezoelectric elements 31 extends rightward or leftward. Specifically, as illustrated in FIG. 3, the driving wires 42 extend rightward from the respective piezoelectric elements 31 constituting the right two piezoelectric element groups 39*k*, 39*y* of the four piezoelectric element groups 39, and the driving wires 42 extend leftward from the respective piezoelectric elements 31 constituting the left two piezoelectric element groups 39*c*, 39*m* of the four piezoelectric element groups 39.

Each of the driving contacts 46 is provided on an end portion of a corresponding one of the driving wires 42, which end portion is located on an opposite side of the driving wire 42 from its portion on which the second electrode 34 is disposed. The driving contacts 46 are arranged in a row in the conveying direction at each of a right end portion and a left end portion of the piezoelectric actuator 22. In the present embodiment, the nozzles 24 forming the nozzle group 27 of each color are arranged at intervals of 600 dpi (=42 μm). Also, each of the driving wires 42 extends rightward or leftward from the piezoelectric element 31 corresponding to the nozzle groups 27 associated with corresponding two colors. Accordingly, at each of the right end portion and the left end portion of the piezoelectric actuator 22, the driving contacts 46 are arranged at very short intervals of a half of those of the nozzles 24 of each nozzle group 27, that is, the driving contacts 46 are arranged at the intervals of about 21 μm.

The two ground contacts 47 are respectively disposed in front of and at a rear of the driving contacts 46 arranged in a row in the front and rear direction. Each of the ground contacts 47 has a larger contacting area than each of the driving contacts 46. Each of the ground contacts 47 is connected to the common electrode 36 via a corresponding one of conductive portions 65 (see FIGS. 7 and 9B) which extends through the protecting layer 40 and the insulating layer 41 located just under the ground contact 47.

The driving contacts 46 and the ground contacts 47 disposed on the right end portion and the left end portion of the piezoelectric actuator 22 are exposed from the protector 23. The two COFs 50 are respectively joined to the right end portion and the left end portion of the piezoelectric actuator 22. Each of the driving contacts 46 is connected to a corresponding one of the driver ICs 51 via a corresponding one of the individual wires 52 of the COFs 50. A drive signal is supplied from the driver IC 51 to the driving contacts 46. Each of the ground contacts 47 is connected to a corresponding one of the ground wires 53 of the COFs 50. A ground potential is applied from the ground wire 53 to the ground contact 47. Joint portions of the piezoelectric actuator 22 and the COFs 50 will be explained later in detail.

As illustrated in FIG. 5, the wire protecting layer 43 is disposed so as to cover the driving wires 42. The wire protecting layer 43 increases insulation between the driving wires 42. Also, the wire protecting layer 43 inhibits oxidation of a material, e.g., Al, of the driving wires 42. The wire protecting layer 43 is formed of silicon nitride (SiNx), for example.

As illustrated in FIGS. 5 and 6, in the present embodiment, each of the second electrodes 34 is exposed from the protecting layer 40, the insulating layer 41, and the wire protecting layer 43 except its peripheral portion. That is, deformation of the piezoelectric layers 33 is not hindered by the protecting layer 40, the insulating layer 41, and the wire protecting layer 43.

Joint Portion of Piezoelectric Actuator and COF

There will be next explained a detailed construction of the joint portion of the piezoelectric actuator 22 and each of the COFs 50 with reference to FIGS. 5 and 7-9C.

As described above, the driving contacts 46 and the two ground contacts 47 are provided at each of the right and left end portions of the piezoelectric actuator 22. The driving contacts 46 are drawn out from the second electrodes 34 of the respective piezoelectric elements 31 and arranged in the front and rear direction. The two ground contacts 47 are disposed respectively on opposite sides of the driving contacts 46 in the front and rear direction. Each of the COFs 50 is joined to the corresponding end portion of the piezoelectric actuator 22 with a conductive adhesive 60.

The conductive adhesive 60 is formed by mixing conductive particles into thermosetting resin such as epoxy resin. The conductive adhesive 60 is generally used in the form of a film or a paste. One example of the film is an anisotropic conductive film (ACF), and one example of the paste is an anisotropic conductive paste (ACP). The driving contacts 46 and the ground contacts 47 of the piezoelectric actuator 22 are respectively connected to the individual contacts 54 and the ground contact 55 provided on the COFs 50 by the conductive particles of the conductive adhesive 60.

Figure 7:
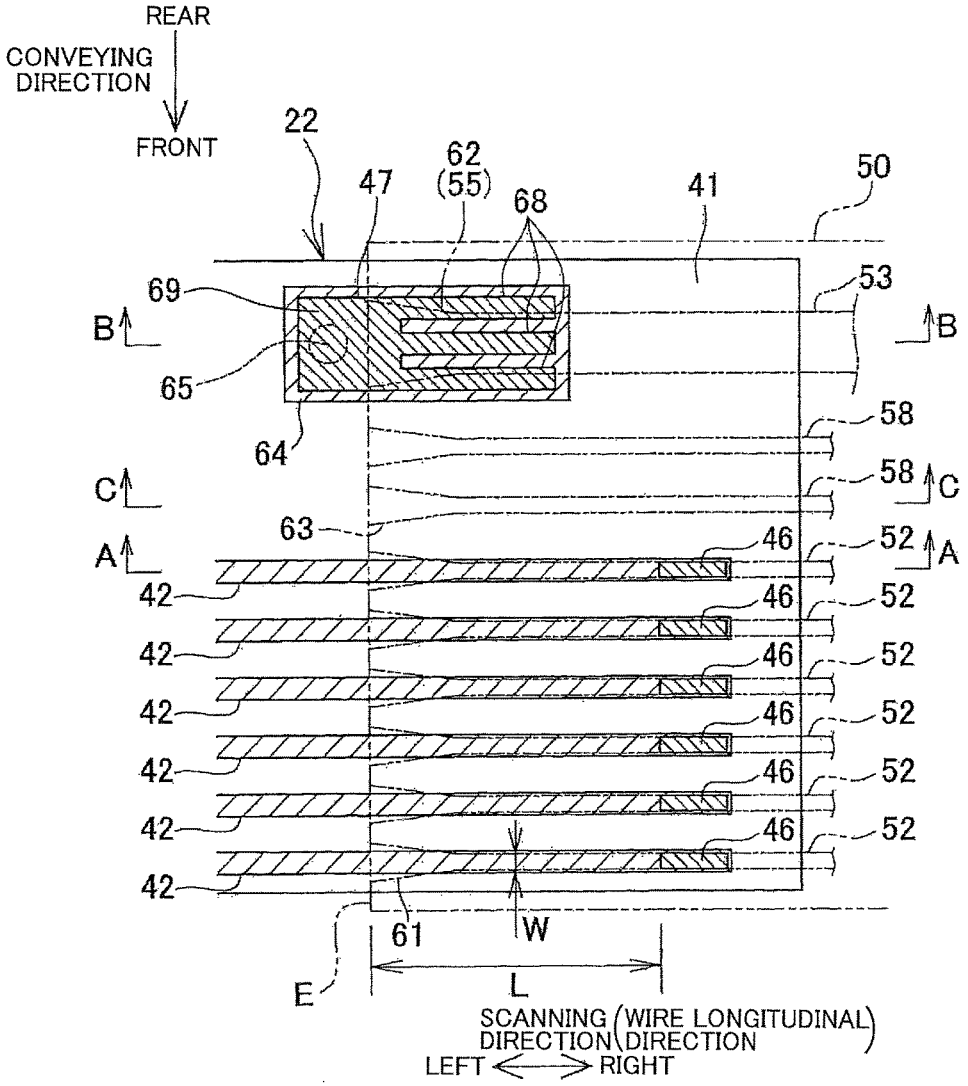
FIG. 7 is an enlarged view of an area B in FIG. 4.
Figure 9A:
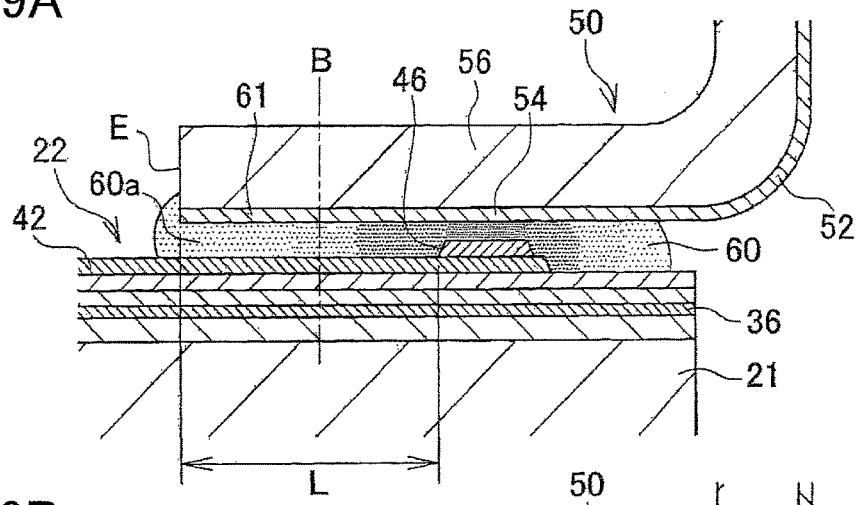
FIG. 9A is a cross-sectional view taken along line A-A in FIG. 7.

First, the configuration of the contacts of the piezoelectric actuator 22 will be described. As illustrated in FIGS. 7 and 9A, each of the driving contacts 46 is formed on a distal end portion of the corresponding driving wire 42 disposed on the insulating layer 41. Each of the driving contacts 46 is formed of gold (Au), for example.

Base layers 64 are disposed on the insulating layer 41 at positions located on an outer side of the driving contacts 46. Each of the base layers 64 is formed of the same material as the driving wires 42. For example, each base layer 64 is formed of aluminum (Al). Each base layer 64 is connected to the common electrode 36 via a corresponding one of the conductive portions 65 which extends through the protecting layer 40 and the insulating layer 41 located just under the base layer 64. The ground contacts 47 are formed on the respective base layers 64. Each of the ground contacts 47 is formed of the same material as the driving contacts 46. For example, each ground contact 47 is formed of gold (Au). More specifically, each of the ground contacts 47 includes: three small contacts 68 spaced apart from each other in the front and rear direction; and a connecting portion 69 connecting left end portions (in FIG. 7) of the three small contacts 68 to each other. The area of the ground contact 47 is larger than the driving contact 46.

As illustrated in FIG. 7, the base layer 64 and the ground contact 47 disposed thereon are disposed on an inner side of the driving contacts 46 in the right and left direction, in other words, the base layer 64 and the ground contact 47 are disposed nearer to an edge E of the COF 50 than the driving contacts 46 in the right and left direction.

The configuration of the wires provided on the COF 50 will be described next. As illustrated in FIGS. 7-8B, the individual wires 52 and the ground wires 53 extending in the right and left direction are formed on an actuator-side surface of an end portion of the base 56 of each of the COFs 50. For each of the COFs 50, the individual wires 52 are connected to the driver IC 51 (see FIG. 5). A drive signal output from the driver IC 51 is supplied from the driver IC 51 to the second electrodes 34 of the respective piezoelectric elements 31. Like the driving contacts 46 of the piezoelectric actuator 22, the individual wires 52 are arranged at a very short pitch, e.g., about 21 μm. The ground wire 53 is connected to a ground wire, not illustrated, of the printer 1 to apply a ground potential to the first electrodes 32 of the respective piezoelectric elements 31. The wire width of the ground wire 53 is larger than that of each of the individual wires 52. The wire width is a width of a wire in the front and rear direction orthogonal to the right and left direction coinciding with the longitudinal direction of the wire.

At each of the right and left end portions of the piezoelectric actuator 22, two dummy wires 58 each extending along the wires 52, 53 are disposed between the ground wire 53 and the individual wires 52. The dummy wires 58 are independent wires not connected to any of the individual wires 52 and the ground wire 53. The dummy wires 58 prevent shorts between the ground wire 53 connected to the first electrodes 32 and the individual wires 52 connected to the respective second electrodes 34. The wire width of each of the dummy wires 58 is the same as that of each of the individual wires 52.

Figure 8A:
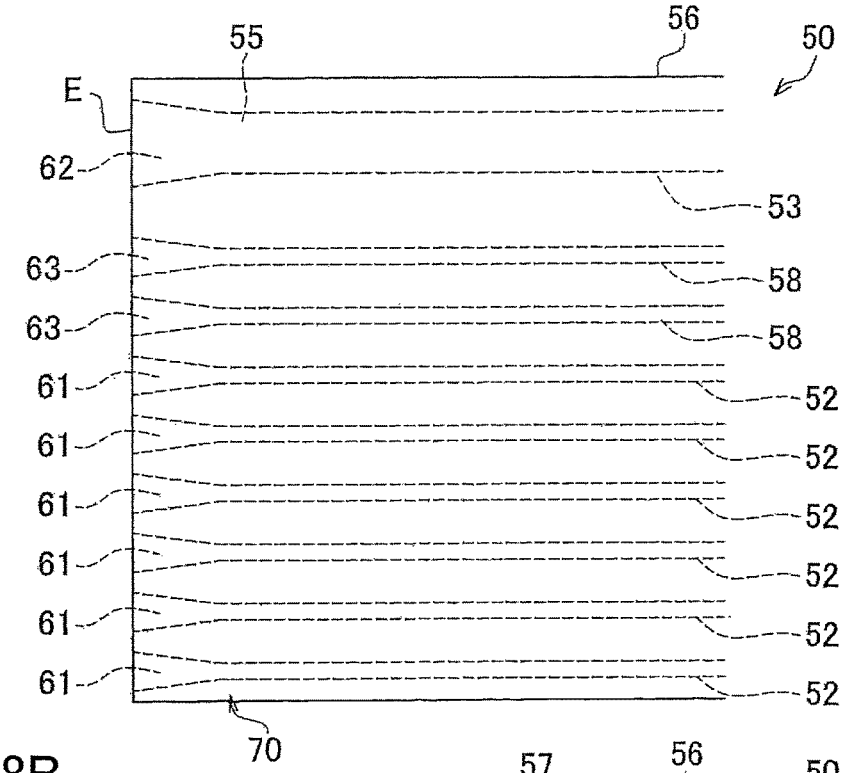
Figure 8B:
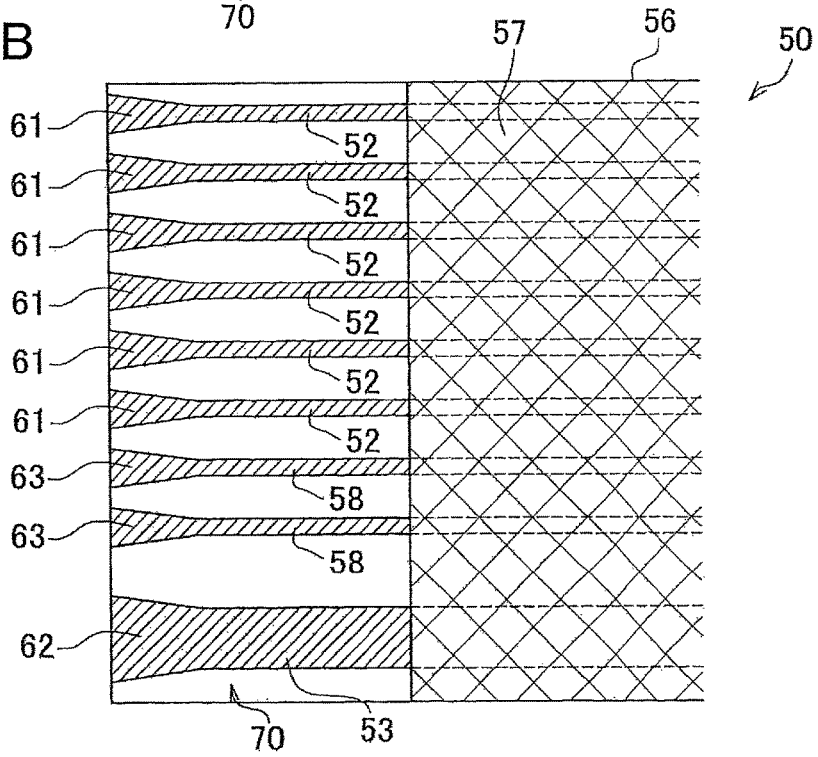

As illustrated in FIGS. 8A and 8B, the individual wires 52, the ground wire 53, and the dummy wires 58 extend in the right and left direction in FIGS. 8A and 8B. The COF 50 includes an edge portion 70 having the left edge E, and distal end portions of the wires 52, 53, 58 are located at the edge portion 70 of the COF 50. Each of the wires 52, 53, 58 has a larger width at its distal end portion than at its portion located nearer to a basal end of the wire than the distal end portion (its portion located to the right of the distal end portion). That is, the distal end portion of each individual wire 52 has a wide portion 61 as a partially wide portion. Likewise, the distal end portion of the ground wire 53 has a wide portion 62, and the distal end portion of each of the dummy wires 58 has a wide portion 63. It is noted that the wide portions 61, 62, 63 extend over substantially the same region in the right and left direction. That is, end positions (i.e., positions indicated by two-dot chain lines B in FIG. 9) of the wide portions 61, 62, 63 which are located on an opposite side thereof from the edge E of the COF 50 in the right and left direction are substantially the same as each other. As will be explained later, the wide portions 61, 62, 63 are formed by cutting the base 56 after the wires 52, 53, 58 are formed on the base 56 in a process of manufacture of the COF 50.

As illustrated in FIG. 8B, each of the individual wires 52, the ground wire 53, and the dummy wires 58 is covered with an insulating layer 57 in the form of a solder resist, except a distal end portion of each of the individual wires 52, the ground wire 53, and the dummy wires 58.

As illustrated in FIGS. 7 and 9A-9C, the left edge E of the COF 50 overlaps the ground contact 47 in a state in which the COF 50 is joined to the piezoelectric actuator 22. The driving contacts 46 of the piezoelectric actuator 22 are located further toward the right than the ground contact 47 and spaced apart from the edge E in the right and left direction. Thus, as illustrated in FIG. 9A, the wide portion 61 of each of the individual wires 52 is disposed further toward the left than the driving contacts 46 in the right and left direction as one example of a wire direction and a wire longitudinal direction. In other words, the wide portion 61 is disposed nearer to the edge E than the driving contacts 46 in the right and left direction. That is, the individual contacts 54 of the COF 50 which are connected to the driving contacts 46 are provided on the respective individual wires 52 at respective positions spaced apart from the respective wide portions 61 in a direction directed from the edge E of the COF 50 toward basal ends of the respective individual wires 52. In other words, the individual contacts 54 are provided on the respective individual wires 52 at the respective positions located further toward the right than the respective wide portions 61.

Figure 9B:
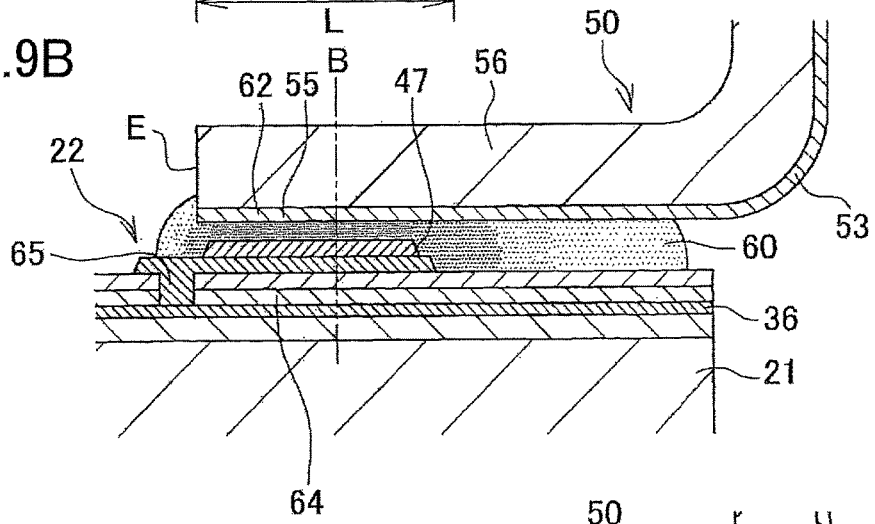
FIG. 9B is a cross-sectional view taken along line B-B in FIG. 7.

As illustrated in FIG. 7, the ground contact 47 of the piezoelectric actuator 22 is located nearer to the edge E of the COF 50 than the driving contacts 46 in the right and left direction. As illustrated in FIG. 9B, the wide portion 62 of the ground wire 53 overlaps the ground contact 47 when viewed from above. That is, the ground contact 55 of the COF 50 which is connected to the ground contact 47 includes the wide portion 62 of the ground wire 53.

The width of each ground contact 55 of the COF 50 in the front and rear direction, in particular, the width of the wide portion 62 is larger than that of each of the small contacts 68 of the ground contact 47 of the piezoelectric actuator 22. The wide portion 62 of the ground contact 55 is disposed over the three small contacts 68 of the ground contact 47.

Figure 9C:
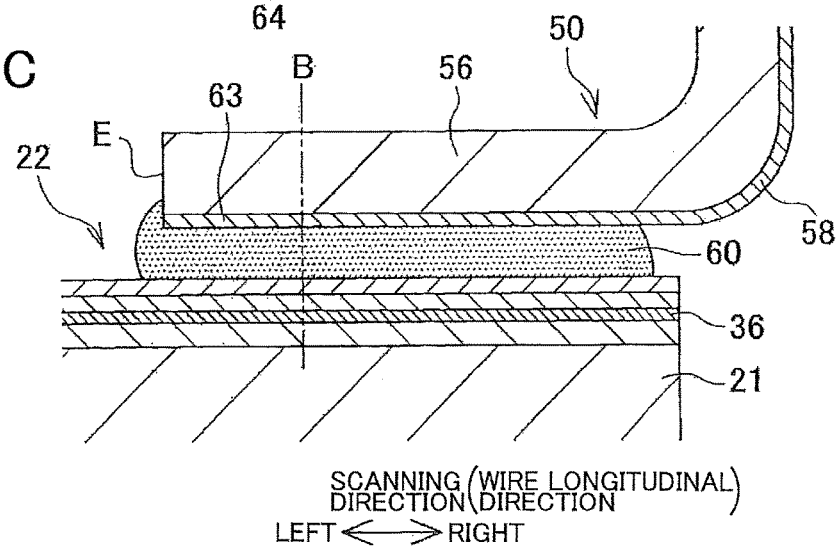
FIG. 9C is a cross-sectional view taken along line C-C in FIG. 7.

Like the wide portions 61 of the respective individual wires 52, as illustrated in FIG. 9C, the wide portions 63 of the respective dummy wires 58 are disposed further toward the left than the driving contacts 46. Unlike the individual wires 52 and the ground wire 53, the dummy wires 58 are not connected to the wires of the piezoelectric actuator 22.

The contacts 46, 47 of the piezoelectric actuator 22 and the contacts 54, 55 of the COF 50 are electrically connected to each other via the conductive particles contained in the conductive adhesive 60. Thermosetting resin, which is a main component of the conductive adhesive 60, has flowed out to areas around these contacts. Hardening of the thermosetting resin mechanically joins the piezoelectric actuator 22 and the base 56 of the COF 50 to each other.

The density of the conductive particles of the conductive adhesive 60 around the contacts is considerably lower than that of the conductive particles of the conductive adhesive 60 between the contact 46 and the contact 54 and between the contact 47 and the contact 55. In other words, when the conductive adhesive 60 is compressed between each of the contacts 46, 47 of the piezoelectric actuator 22 and a corresponding one of the contacts 54, 55 of the COF 50, the thermosetting resin as the main component of the conductive adhesive 60 flows out to the area around the contacts in advance of the conductive particles, resulting in increase in the density of the conductive particles between the contacts. In FIGS. 9A and 9B, thick hatching indicates a portion of the conductive adhesive 60 between the contacts with a high density of the conductive particles. Since the density of the conductive particles decreases with increase in distance from the contacts, the density of the hatching indicating the adhesive 60 decreases with increase in distance from the contacts in FIGS. 9A and 9B. Accordingly, the contacts 46, 47 of the piezoelectric actuator 22 and the contacts 54, 55 of the COF 50 are electrically connected to each other with the conductive particles disposed at high densities. In contrast, the density of the conductive particles is low around the contacts, leading to less occurrence of conduction through the conductive particles.

In the present embodiment as described above, the wide portions 61, 62, 63 are respectively formed at the distal end portions of the respective wires 52, 53, 58 which are located at the edge portion 70 of the COF 50. In this construction, each of the individual wires 52 arranged by a short distance has a long wire width at the wide portion 61. Accordingly, the distance between the individual wires 52 is short at the edge E. Thus, if the individual wire 52 is connected to the driving contact 46 of the piezoelectric actuator 22 at the wide portion 61, shorts occur with a higher possibility between the individual wires 52 next to each other or between the individual wire 52 and the driving contact 46 to be connected to another individual wire 52.

For example, when the COF 50 is joined to the piezoelectric actuator 22, even slight misalignment of a position of the COF 50 with respect to the piezoelectric actuator 22 may cause shorts between the individual wire 52 and the driving contact 46 that is located next to the individual wire 52 and that is not intended to be connected thereto. Also, in the case where the COF 50 is joined to the driving contact 46 with the conductive adhesive 60 as in the present embodiment, and the conductive particles of the conductive adhesive 60 has flowed out to the area around the driving contact 46, a possibility of occurrence of shorts increases with decrease in the distance between the individual wires 52 next to each other.

In the present embodiment, however, the wide portion 61 of each of the individual wires 52 of the COF 50 is disposed beyond the corresponding driving contact 46 so as to protrude from the driving contacts 46 in the longitudinal direction of the individual wire 52. In other words, the wide portion 61 is located nearer to the edge E of the COF 50, which edge E is connected to the piezoelectric actuator 22, than the driving contact 46 in the right and left direction. The individual contacts 54 to be connected to the respective driving contacts 46 are located nearer to the basal ends of the respective individual wires 52 than the respective wide portions 61. That is, the width of a portion of the individual wire 52 which is connected to the driving contact 46 is less than that of the wide portion 61. Accordingly, a distance between (i) each of the individual wires 52 and (ii) another individual wire 52 or the driving contact 46 disposed next to said each of the individual wires 52 is not large, thereby preventing shorts.

From the viewpoint of more reliably preventing shorts, a distance L between the driving contact 46 and a distal end of the wide portion 61, i.e., an amount of protrusion (protruding amount) of the individual wire 52 from the driving contact 46 is preferably greater than or equal to twice the width W of the individual wire 52. However, if the protruding amount (the distance L) is too large, a large area is required for a portion of the piezoelectric actuator 22 which is joined to the COF 50, leading to increase in size of the piezoelectric actuator 22. From this viewpoint, the distance L is preferably less than or equal to twenty times the width W of the individual wire 52.

As illustrated in FIGS. 9A and 9B, the conductive adhesive 60 covers the areas around the joint portions of the contacts 46, 47 and the joint portions of the contacts 54, 55. In particular, a portion 60*a* of the conductive adhesive 60 covers the wide portion 61 of the individual wire 52 which is not connected to the driving contact 46 of the piezoelectric actuator 22. The density of the conductive particles is lower at the portion 60*a* covering the wide portion 61 than at the portion of the conductive adhesive 60 which connects the driving contact 46 and the individual contact 54 to each other. This construction more reliably prevents shorts between the individual wires 52 and between the individual wire 52 and the driving contact 46. It is noted that any insulating materials may be used as a material covering the wide portion 61. However, covering the wide portion 61 with the conductive adhesive 60 at joining eliminates a need of a step of thereafter covering the wide portion 61 with another material.

The ground contact 47 and the ground contact 55 are connected to the common electrode 36. Since a large amount of current flows in the common electrode 36 when many piezoelectric elements 31 are driven at the same time, a resistance of paths connected to the common electrode 36 needs to be small in order to prevent a drop in voltage. From this viewpoint, the resistance between the ground contact 47 and the ground contact 55 at the joint portion therebetween is preferably small.

In this regard, the ground contact 55 of the COF 50 includes the wide portion 62 of the ground wire 53 in the present embodiment. The ground contact 47 of the piezoelectric actuator 22 is disposed nearer to the edge E of the COF 50 than the driving contact 46. With this construction, the ground contact 47 is connected to the ground contact 55 including the wide portion 62. This connection reduces the resistance at the joint portion of the ground contact 47 and the ground contact 55.

As illustrated in FIG. 7, the ground contact 47 of the piezoelectric actuator 22 includes the three small contacts 68. The ground contact 55 of the COF 50 is disposed over the three small contacts 68 of the ground contact 47. With this construction, the adhesive 60 enters areas each interposed between corresponding adjacent two of the three small contacts 68, resulting in increased strength of joining between the piezoelectric actuator 22 and the COF 50.

In the present embodiment, as illustrated in FIG. 7, the dummy wires 58 are disposed between the ground wire 53 and the individual wire 52 of the COF 50 to prevent shorts therebetween. Like the wide portion 61 of the individual contact 54, the wide portion 63 formed at the distal end portion of each of the dummy wires 58 is disposed beyond the driving contacts 46 in the wire direction, that is, the wide portion 63 is located nearer to the edge E of the COF 50 than the driving contacts 46 in the wire direction. In this construction, the wide portion 63 of the dummy wire 58 is also disposed spaced apart from the driving contact 46. This arrangement prevents conduction between the driving contact 46 and the dummy wire 58 that is to be an independent pattern separated from both of the ground wire 53 and the individual wires 52.

As illustrated in FIG. 9C, like the wide portion 61 of the individual wire 52, the wide portion 63 of the dummy wire 58 is covered with the conductive adhesive 60. This construction reliably prevents conduction between the dummy wire 58 and each of the individual wire 52 and the driving contact 46.

There will be next explained manufacturing of the ink-jet head 4, focusing mainly on a step of producing the COF 50 of the actuator device 25 and on a step of joining the COF 50 to the piezoelectric actuator 22.

Wire Forming Step

Figure 10A:
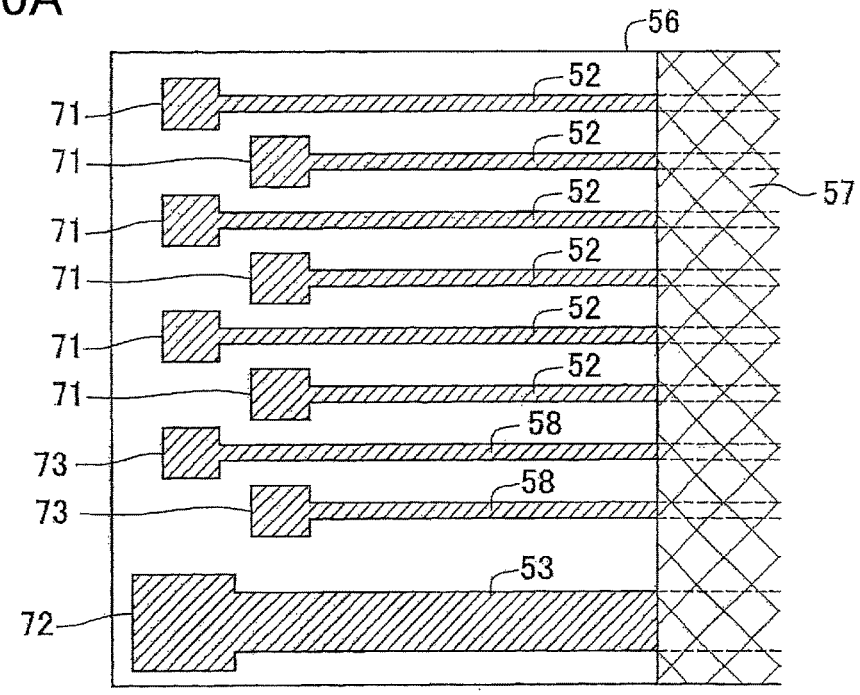
FIGS. 10A and 10B are views illustrating a process of producing the COF.
Figure 10B:
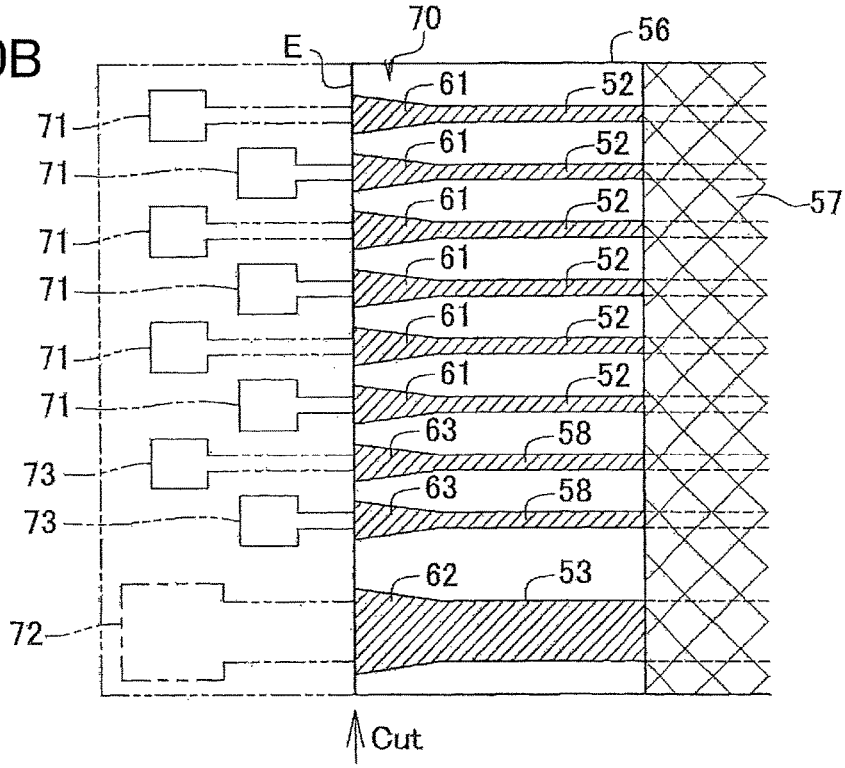

There will be explained the step of producing the COF 50 with reference to FIGS. 10A and 10B. As illustrated in FIG. 10A, a wire pattern including the individual wires 52, the ground wires 53, and the dummy wires 58 is formed on one of opposite surfaces of the base 56 in the form of a film formed of resin such as polyimide. With this formation of the wire pattern, test contacts 71, 72, 73 are also formed so as to be respectively connected to the distal end portions of the individual wires 52, the ground wires 53, and the dummy wires 58. Each of the test contacts 71, 72, 73 has a larger width than the corresponding one of the wires 52, 53, 58 and has an area larger than or equal to a predetermined area.

Covering Step

After the wire pattern is formed on the base 56, the insulating layer 57 in the form of the solder resist is formed substantially the entire surface of the base 56 except an area on which distal end portions of the wires 52, 53, 58 and the test contacts 71, 72, 73 are disposed. Also, the driver IC 51 is mounted on the base 56.

Testing Step

A Probe, not illustrated, is brought into contact with the test contacts 71, 72, 73 to perform conduction tests for the respective wires 52, 53, 58. It is noted that the dummy wires 58 are independent wires not connected to the driver ICs 51 or the ground, but, like the individual wires 52 and the ground wires 53, the conduction tests are performed for the respective dummy wires 58 for checking that the dummy wire 58 does not conduct with the individual wire 52 or the ground wire 53 disposed next to the dummy wires 58.

Cutting Step

After the completion of the conduction tests, the test contacts 71, 72, 73 are no longer needed. Thus, as illustrated in FIG. 10B, the base 56 is cut along positions each located between each of the wires 52, 53, 58 and a corresponding one of the test contacts 71, 72, 73. A method of cutting the base 56 is not limited in particular. For example, the base 56 may be cut by shearing using two metal molds. In the present embodiment, since the base 56 is constituted by the polyimide film, it is easy to cut the base 56 using the molds. However, the wires are crushed in some degree at positions where the base 56 is cut, so that the wide portions 61, 62, 63 are formed on the respective wires 52, 53, 58 at the edge portion 70 of the base 56 which includes the cut edge E. In the case where a material having more resistance to cut than the polyimide film is used as the base 56, the wires are crushed by a larger amount, leading to larger sizes of the wide portions 61, 62, 63. For example, in the case where the width of the wire 52 is 10 μm, the maximum width of the wide portion 61 at the cut edge E is about 15 μm.

Joining Step

The COF 50 manufactured in the above-described steps are then joined to the piezoelectric actuator 22. In this joining step, the conductive adhesive 60 (ACF or ACP) is first applied to the individual wires 52 and the ground wires 53 exposed from the insulating layer 57 at the edge portion 70 of the COF 50.

Figure 11:
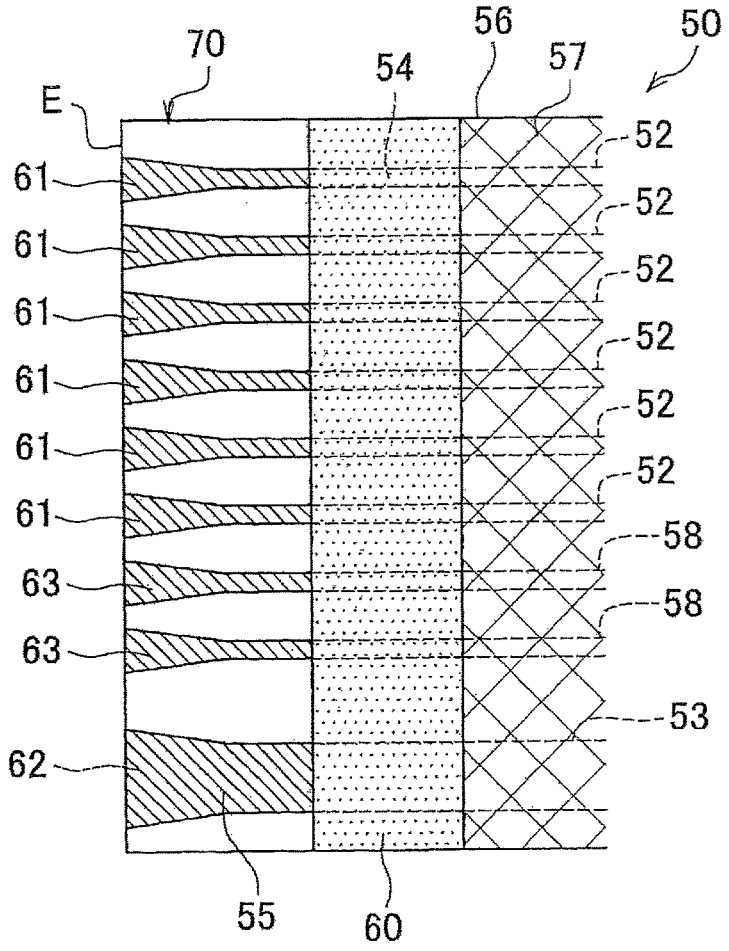
FIG. 11 is a view illustrating an adhesive area of the surface of the COF on which the wires are arranged.

In the joining using the conductive adhesive 60, as described above, in the case where the conductive particles contained in the adhesive 60 have flowed out to the areas around the contacts with the thermosetting resin, unnecessary conductions (shorts) may be caused at positions different from conduction-required positions. In the present embodiment, to solve this problem, the conductive adhesive 60 is applied not to the entire area of the base 56 which is exposed from the insulating layer 57 but mainly to an area on which conduction is required. For example, as illustrated in FIG. 11, the conductive adhesive 60 is not applied to the edge portion 70 including the edge E, on the area of the base 56 which is exposed from the insulating layer 57. As a result, the wide portions 61 of the individual wires 52 and the wide portions 63 of the dummy wires 58 are not covered with the conductive adhesive 60 on the base 56 not having been joined yet. It is noted that the wide portion 62 of the ground wire 53 is not covered with the conductive adhesive 60 in FIG. 11, either, but the conductive adhesive 60 may be applied to the wide portion 62 because the wide portion 62 is to conduct with the ground contact 47.

Figure 12:
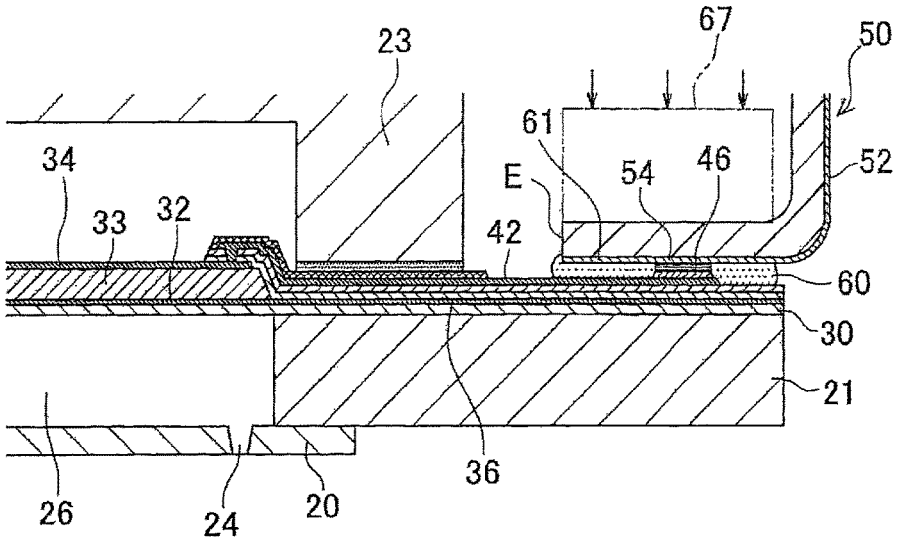
FIG. 12 is a view illustrating a joining step of the COF.

As illustrated in FIG. 12, the COF 50 is then placed onto the piezoelectric actuator 22 at the region on which the contacts 46, 47 are arranged. In this placement, the COF 50 is placed such that the individual contact 54 of the individual wire 52 which is located further from the edge E of the base 56 than the wide portion 61 overlaps the driving contact 46 of the piezoelectric actuator 22. A heater plate 67 is then pressed against an upper surface of the COF 50.

This pressing of the heater plate 67 heats and compresses the conductive adhesive 60 between the piezoelectric actuator 22 and the COF 50. During this operation, the thermosetting resin contained in the adhesive 60 flows out to the areas around the contacts at the areas between each driving contact 46 and the corresponding individual contact 54 and between each ground contact 47 and the corresponding ground contact 55, whereby the contacts conduct with each other by the conductive particles. Furthermore, the thermosetting resin having flowed out to the areas around the contacts are hardened, so that the piezoelectric actuator 22 and the COF 50 are mechanically joined to each other.

It is noted that the conductive adhesive 60 is not applied to the wide portions 61 of the individual wires 52 and the wide portions 63 of the dummy wires 58 before the joining as illustrated in FIG. 11, but appropriate control of the temperature and the pressing force of the heater plate 67 at the joining enables the wide portions 61, 63 to be covered with the conductive adhesive 60 having flowed from areas around the wide portions 61, 63. The temperature and the pressing force of the heater plate 67 are also controlled so as not to cause outflows of the conductive particles from the areas between each of the contacts 46, 47 of the piezoelectric actuator 22 and the corresponding one of the contacts 54, 55 of the COF 50. With these controls, the density of the conductive particles covering the wide portions 61, 63 is made lower than the density of the conductive particles at the areas at which the contacts are connected to each other.

In the embodiment described above, the ink-jet head 4 is one example of a liquid ejector. The piezoelectric actuator 22 is one example of an actuator. The front and rear direction (the conveying direction) is one example of a first direction. The right and left direction (the scanning direction) is one example of a second direction. The right and left direction (the scanning direction) coincides with a direction in which each of the wires 52, 53, 58 on the COF 50 extends, and the right and left direction (the scanning direction) is one example of the wire direction.

Each of the COFs 50 is one example of a wire member. Each of the driver ICs 51 is one example of a drive circuit. Each of the individual contacts 54 of the COFs 50 is one example of a first contact. Each of the individual wires 52 is one example of a first wire. Each of the wide portions 61 is one example of a first wide portion. Each of the ground contacts 55 of the COFs 50 is one example of a second contact. Each of the ground wires 53 is one example of a second wire. Each of the wide portions 62 is one example of a second wide portion. Each of the dummy wires 58 is one example of a third wire. Each of the wide portions 63 is one example of a third wide portion. Each of the driving contacts 46 of the piezoelectric actuator 22 is one example of a first element contact. Each of the three small contacts 68 of the ground contact 47 is one example of a second element contact.

There will be next explained modifications of the embodiment. It is noted that the same reference numerals as used in the above-described embodiment are used to designate the corresponding elements of the modifications, and an explanation of which is dispensed with.

Figure 13A:
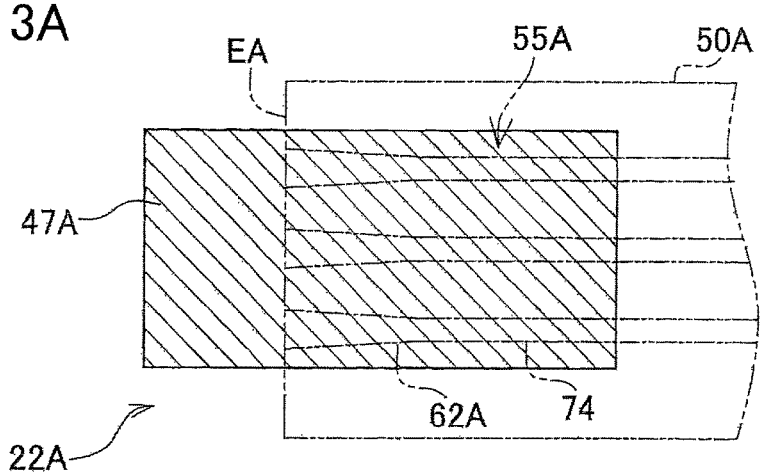
FIGS. 13A-13C are views each illustrating a positional relationship between a ground contact of a piezoelectric actuator and a ground contact of the COF in a corresponding modification.

In the above-described embodiment, each of the ground contacts 47 of the piezoelectric actuator 22 includes the plurality of small contacts 68 (see FIG. 7). In a modification, as illustrated in FIG. 13A, a ground contact 55A of a COF 50A may include a plurality of small contacts 74. In FIG. 13A, the ground contact 55A includes three small contacts 74. A wide portion 62A is formed at a distal end portion of each of the small contacts 74 which is located near an edge EA of the COF 50A. A ground contact 47A of a piezoelectric actuator 22A is what is called a solid pattern and disposed across and over the three small contacts 74 of the ground contact 55A. Also in this construction, the adhesive enters areas each interposed between corresponding adjacent two of the three small contacts 74 at joining of the COF 50A, resulting in increased strength of joining between the piezoelectric actuator 22 and the COF 50A.

Figure 13B:
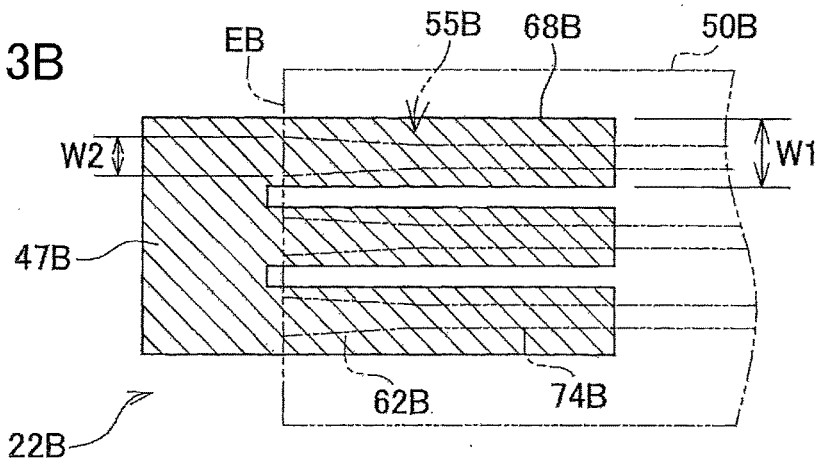

As illustrated in FIG. 13B, this ink-jet head 4 may be configured such that a ground contact 47B of a piezoelectric actuator 22B includes three small contacts 68B, and a ground contact 55B of a COF 50B includes three small contacts 74B. A wide portion 62B is formed at a distal end portion of each of the three small contacts 74B which is located near an edge EB. The three small contacts 68B and the three small contacts 74B are joined to each other in a state in which the small contacts 68B and the respective small contacts 74B overlap each other. Also in this construction, the adhesive enters areas each interposed between corresponding adjacent two of the three small contacts 68B and areas each interposed between corresponding adjacent two of the three small contacts 74B, resulting in increased strength of joining between the piezoelectric actuator 22 and the COF 50B. Furthermore, when compared with the constructions illustrated in FIGS. 7 and 13A, a space between the ground contact 47 and the ground contact 55 has a complicated shape, resulting in greater increase in strength of joining between the piezoelectric actuator 22 and the COF 50B.

In FIG. 13B, the width W1 of each of the small contacts 68B of the ground contact 47B along the edge EB is greater than the width W2 of each of the wide portions 62B of the respective small contacts 74B of the ground contact 55B. In this construction, the small contacts 68B of the ground contact 47B completely overlap the entire wide portions 62B of the respective small contacts 74B, resulting in smaller resistance between the contact 47B and the contact 55B.

Figure 13C:
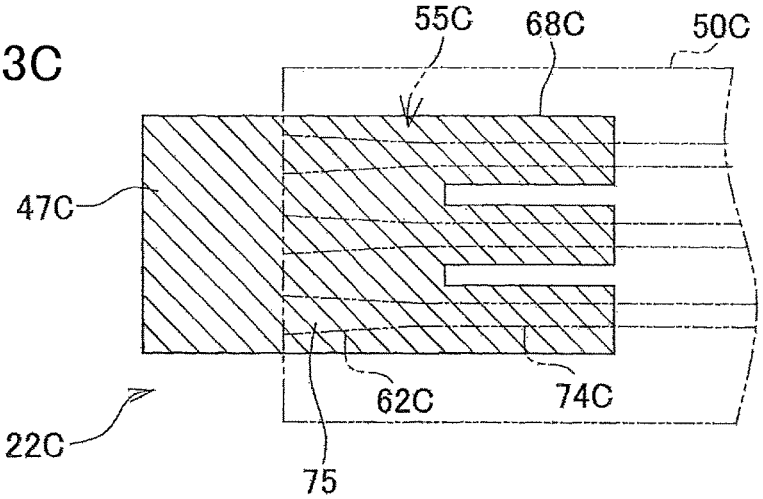

The construction in FIG. 13C is similar to the construction in FIG. 13B but different from the construction in FIG. 13B in that three small contacts 68C of a ground contact 47C of a piezoelectric actuator 22C are continuous to each other at an area overlapping wide portions 62C of respective three small contacts 74C of a ground contact 55C of a COF 50C so as to form a solid pattern 75. Also in this construction, the small contacts 68C of the ground contact 47C completely overlap the entire wide portions 62C of the respective small contacts 74C of the ground contact 55C, resulting in smaller resistance between the contact 47C and the contact 55C.

Figure 14:
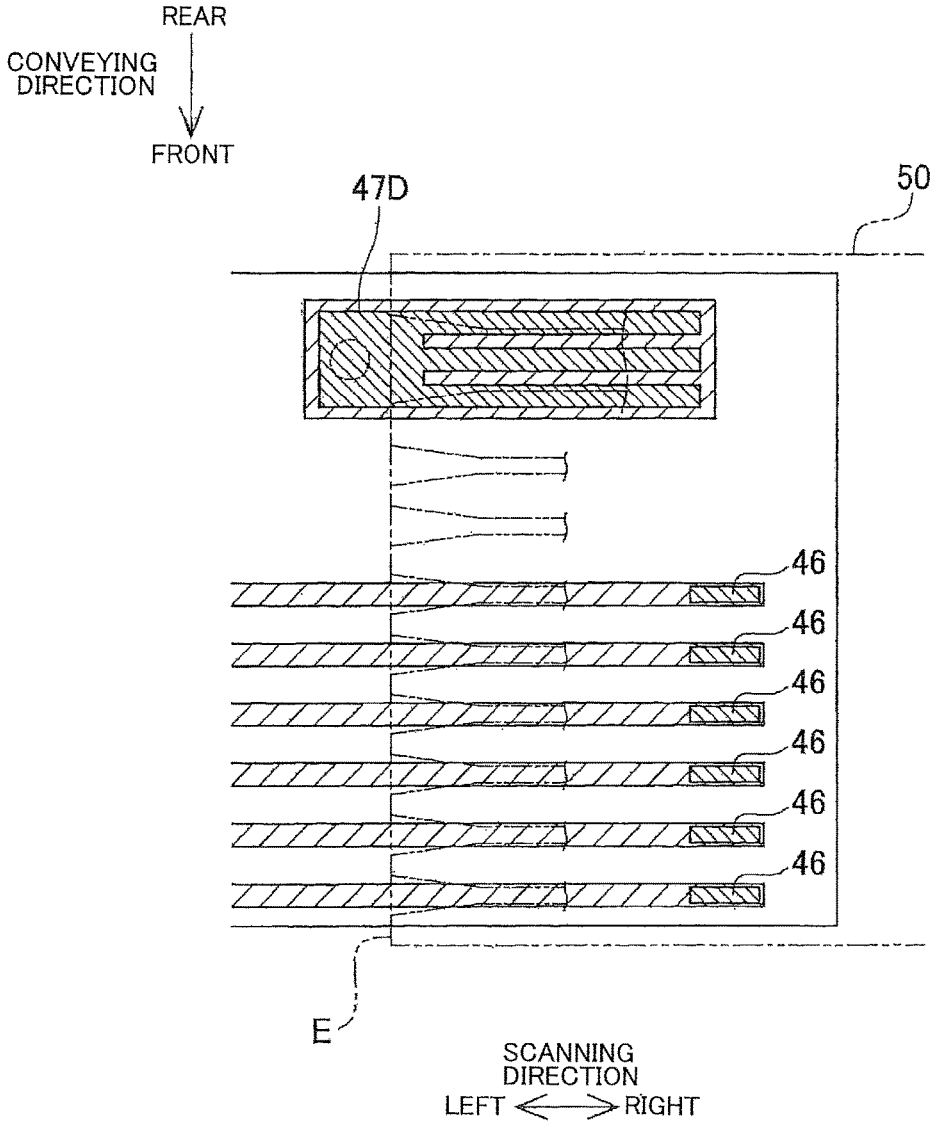
FIG. 14 is an enlarged plan view of a piezoelectric actuator in still another modification, the view corresponding to FIG. 7.

In the above-described embodiment, as illustrated in FIG. 7, the ground contact 47 of the piezoelectric actuator 22 is disposed only at the position located nearer to the edge E of the COF 50 than the driving contacts 46 in the right and left direction. In another modification, as illustrated in FIG. 14, a ground contact 47D may extend to the same position as the driving contacts 46 in the right and left direction. That is, the ground contact 47D only at least needs to have a portion located nearer to the edge E than the driving contacts 46 in the right and left direction.

Figure 15:
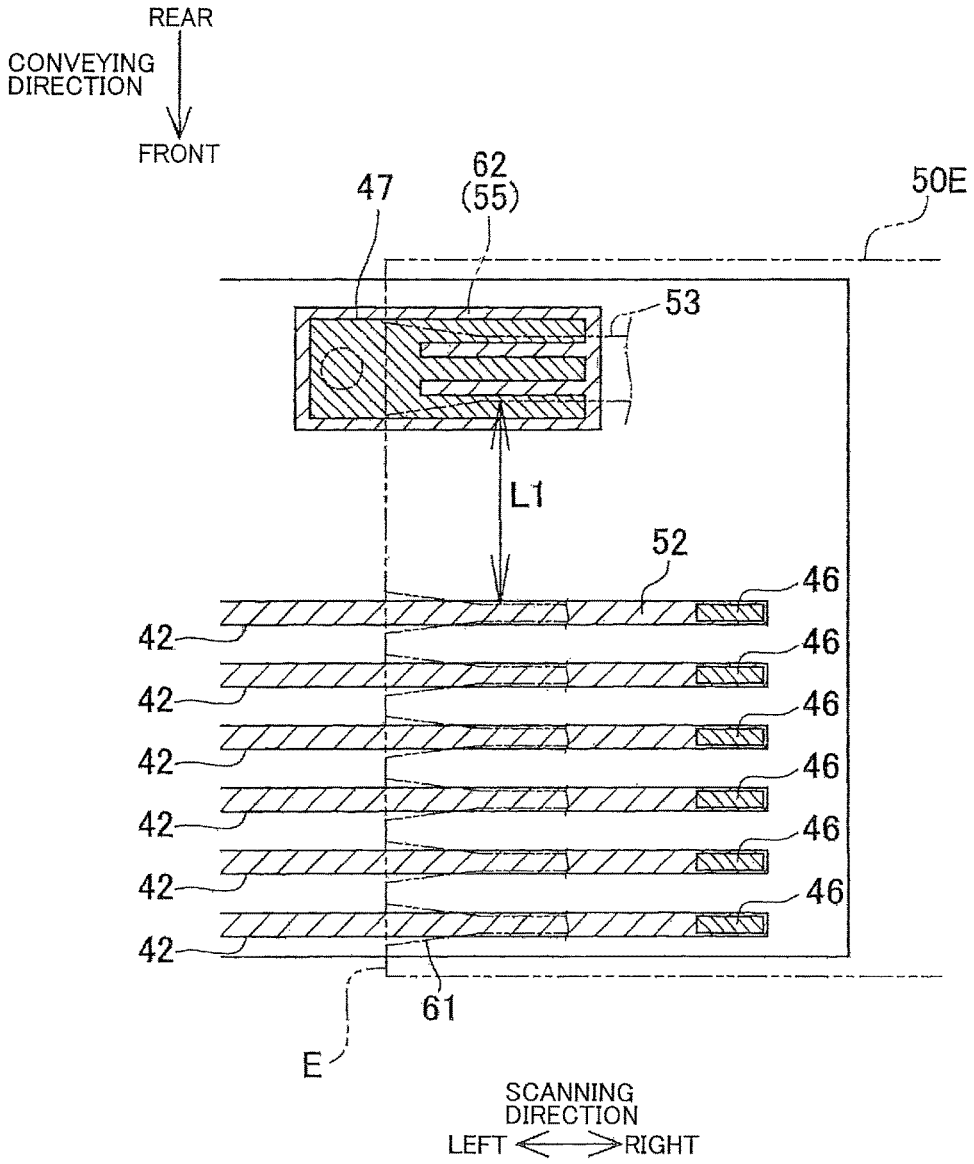
FIG. 15 is an enlarged plan view of a piezoelectric actuator in still another modification, the view corresponding to FIG. 7.

In another modification, as illustrated in FIG. 15, no dummy wires may be provided between the ground wire 53 and the individual wires 52 of a COF 50E. From the viewpoint of preventing shorts between the ground wire 53 and the individual wires 52, these wires 52, 53 are preferably spaced apart from each other at greater than or equal to a predetermined distance L1. Specifically, a space large enough to dispose at least one individual wire 52 therein is preferably formed. For example, in the case where the width of each of the individual wires 52 is 10 μm, the distance L1 is set to be greater than or equal to 20 μm.

Figure 16:
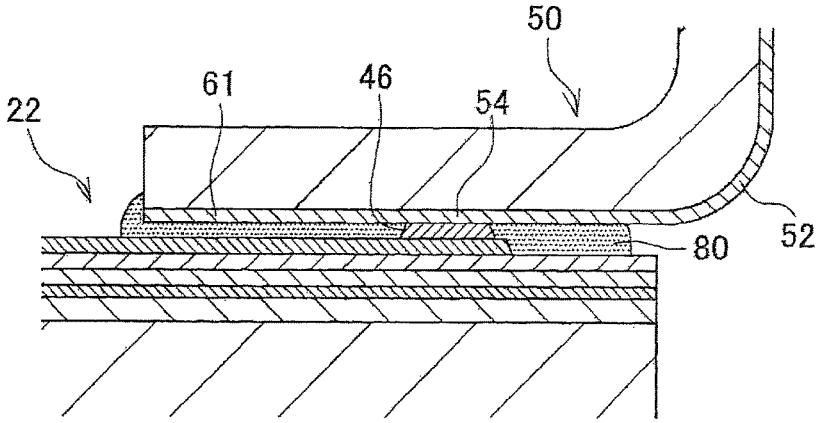
FIG. 16 is a cross-sectional view of an area on which contacts are joined to each other in still another modification.

In the above-described embodiment, the piezoelectric actuator 22 and the COF 50 are joined to each other with the conductive adhesive 60 (ACF or ACP). In another modification, as illustrated in FIG. 16, the piezoelectric actuator 22 and the COF 50 may be joined to each other with a non-conductive adhesive 80 (NCF or NCP). Specifically, the piezoelectric actuator 22 and the COF 50 are mechanically joined to each other by hardening of the adhesive 80 around the contacts in a state in which the driving contacts 46, etc, of the piezoelectric actuator 22 and the individual contacts 54, etc, of the COF 50 are respectively in contact with each other. The non-conductive adhesive 80 contains no conductive particles unlike the conductive adhesive 60. Thus, even in the case where the adhesive has flowed to areas around the contacts at joining, conductions (shorts) do not occur at areas different from the contacts. It is noted that the wide portions 61 of the individual wires 52 of the COF 50 are preferably covered with the non-conductive adhesive 80 also in the construction in FIG. 16.

Figure 17:
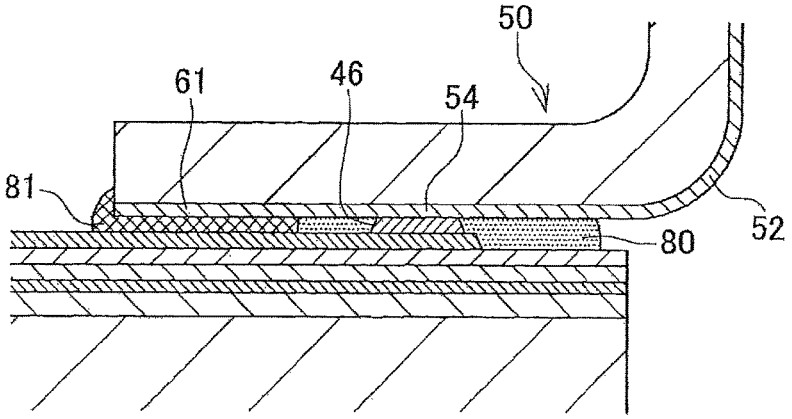
FIG. 17 is a cross-sectional view of an area on which contacts are joined to each other in still another modification.

In another modification, the wide portions of the wires of the COF may not covered with the adhesive used for joining of the COF. For example, as illustrated in FIG. 17, the wide portions 61 of the respective individual wires 52 may be covered with an insulating material 81 different from the adhesive 80.

Figure 18A:
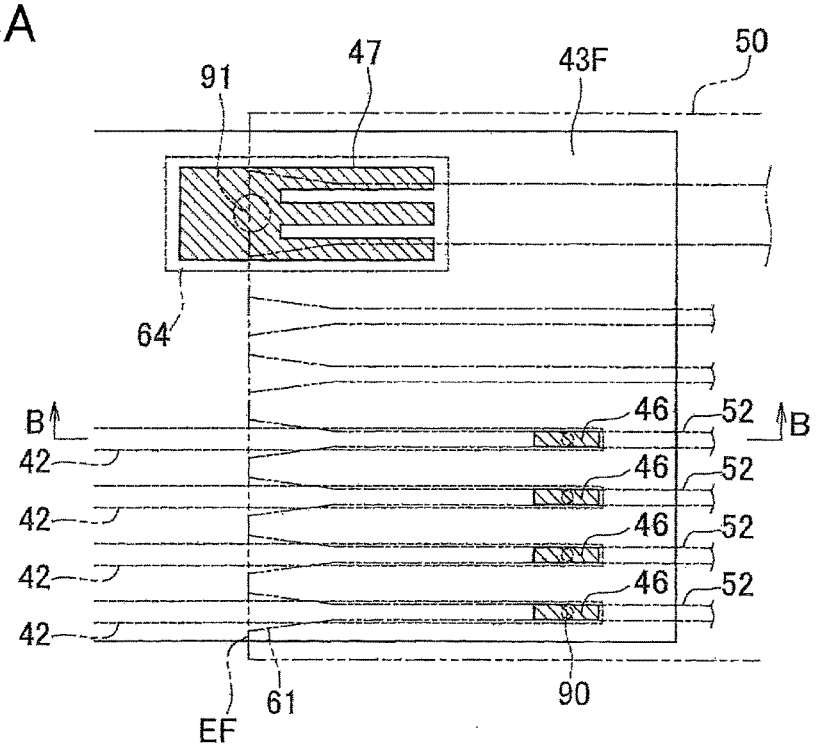
FIG. 18A is an enlarged plan view of a piezoelectric actuator in still another modification, the view corresponding to FIG. 7.
Figure 18B:
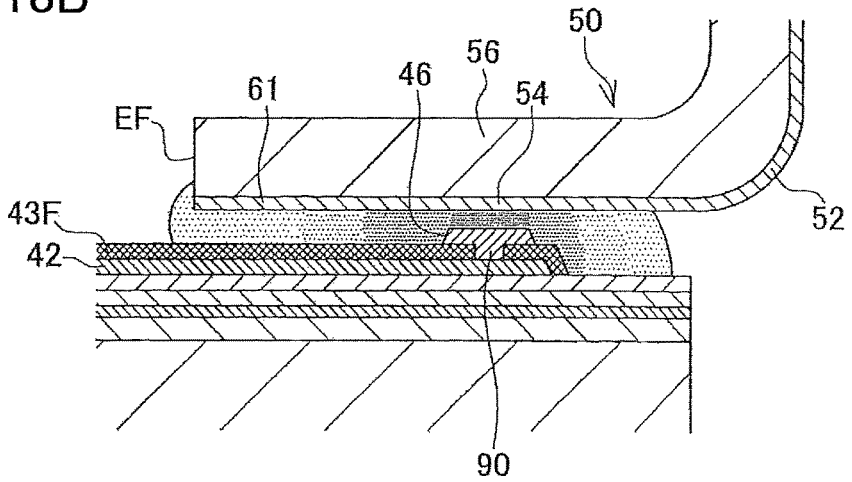
FIG. 18B is a cross-sectional view taken along line B-B in FIG. 18A.

As illustrated in FIGS. 18A and 18B, a wire protecting layer 43F may be formed so as to cover an end portion of each of the driving wires 42 at which a corresponding one of the driving contacts 46 is disposed. The driving contact 46 and the end portion of the driving wire 42 are conductive with each other by a conductive portion 90 extending through the wire protecting layer 43F. In this construction, the wire protecting layer 43F covers the entire driving wires 42 except their portions conductive with the respective driving contacts 46. Thus, even in the case where conductive burrs or fins are formed on an edge EF at cutting of the base 56 (see FIG. 10B) in the manufacturing of the COF 50, the wire protecting layer 43F prevents conduction between the respective individual wires 52 (the respective wide portions 61) of the COF 50 duet to the burrs or fins.

It is noted that the wire protecting layer 43F may cover the base layer 64 on which the ground contact 47 is disposed as illustrated in FIG. 18A. However, the conduction due to the burrs or fins cause few problems in the case of the ground contact 47. Thus, the wire protecting layer 43F may not cover the base layer 64 on which the ground contact 47 is disposed. In the case where the base layer 64 is covered with the wire protecting layer 43F, the base layer 64 and the ground contact 47 are conducted with each other by a conductive portion 91 extending through the wire protecting layer 43F.

The arrangement of the driving contacts and the ground contacts in one ink-jet head is not limited to the arrangement in the above-described embodiment (see FIGS. 2-4). For example, the ink-jet head may be configured such that all the wires of the piezoelectric elements are drawn in one direction, and all the driving contacts are arranged in a row at one end portion of the piezoelectric actuator. The ink-jet head may be configured such that all the wires of the piezoelectric elements are drawn toward a central portion of the piezoelectric actuator, and all the driving contacts are arranged in a row at the central portion of the piezoelectric actuator. The number of the ground contacts is not limited to two and may be one, or three or more.

The ink-jet head 4 in the above-described embodiment is a serial head configured to eject the ink while moving in the widthwise direction of the recording sheet 100. However, the present disclosure may be applied to a line head having nozzles arranged in the widthwise direction of the sheet.

While the present disclosure is applied to the ink-jet head configured to eject the ink onto the recording sheet to record an image in the above-described embodiment, the present disclosure may be applied to actuator devices used for purposes other than liquid ejection. Also, the actuator is not limited to the piezoelectric actuator including a plurality of piezoelectric elements. For example, the actuator may be an actuator including a heater as a drive element which causes driving by utilizing a heat generated when a current passes through the heater.

What is claimed is:

1. An actuator device, comprising:

an actuator comprising at least one drive element and at least one first element contact respectively drawn from the at least one drive element; and a wire member comprising (a) at least one first contact respectively connected to the at least one first element contact and (b) at least one first wire configured to respectively conduct with the at least one first contact, the at least one first wire each comprising a distal end portion disposed at an edge portion of the wire member, a first wide portion being formed at the distal end portion, the first wide portion having a wire width greater than that of a portion of said each of the at least one first wire other than the distal end portion thereof, the first wide portion of each of the at least one first wire being disposed beyond a corresponding one of the at least one first element contact in a wire direction in which said each of the at least one first wire extends, in a state in which the actuator and the wire member are joined to each other, the at least one first contact each being disposed at a basal end portion of a corresponding one of the at least one first wire, the basal end portion being located further from the edge portion of the wire member than the first wide portion, the at least one first contact each being connected to a corresponding one of the at least one first element contact.

2. The actuator device according to claim 1, wherein a distance between the first element contact and a distal end of the first wide portion is greater than or equal to twice a width of the first wire.

3. The actuator device according to claim 2, wherein a distance between the first element contact and a distal end of the first wide portion is less than or equal to twenty times a width of the first wire.

4. The actuator device according to claim 1, wherein the at least one drive element is a plurality of drive elements each comprising a first electrode and a second electrode, wherein a plurality of the second electrodes of the plurality of drive elements are separated from each other, and a plurality of the first electrodes of the plurality of drive elements are connected to each other, and wherein a plurality of first element contacts as the at least one first element contact respectively drawn from the plurality of drive elements are respectively connected to the plurality of second electrodes.

5. The actuator device according to claim 4, wherein the actuator comprises at least one second element contact configured to conduct with the plurality of first electrodes of the plurality of drive elements, wherein the wire member comprises: at least one second contact respectively connected to the at least one second element contact; and at least one second wire extending along the at least one first wire and respectively connected to the at least one second contact, wherein each of the at least one second wire comprises a distal end portion disposed at the edge portion of the wire member, a second wide portion being formed at the distal end portion of said each of the at least one second wire, the second wide portion having a wire width greater than that of a portion of said each of the at least one second wire other than the distal end portion thereof, wherein each of the at least one second contact comprises the second wide portion, wherein the at least one second element contact is disposed nearer to the edge portion of the wire member than the plurality of first element contacts and connected to the at least one second contact each comprising the second wide portion.

6. The actuator device according to claim 5, wherein the wire member comprises a third wire located between the at least one first wire and the at least one second wire and extending toward the edge portion along the at least one first wire and the at least one second wire, and the third wire is not connected to any of the at least one first wire and the at least one second wire.

7. The actuator device according to claim 6, wherein the third wire comprises a distal end portion disposed at the edge portion of the wire member, a third wide portion being formed at the distal end portion of the third wire, the third wide portion having a wire width greater than that of a portion of the third wire other than the distal end portion thereof, and wherein the third wide portion is disposed beyond the at least one first element contact in the wire direction.

8. The actuator device according to claim 5, wherein a distance between the at least one first wire and the at least one second wire of the wire member in a direction along an edge of a base of the wire member is greater than or equal to 20 μm.

9. The actuator device according to claim 5, wherein the actuator comprises a plurality of second element contacts as the at least one second element contact, and wherein one of the at least one second contact is disposed across the plurality of second element contacts.

10. The actuator device according to claim 5, wherein the wire member comprises a plurality of second contacts as the at least one second contact, and wherein one of the at least one second element contact is disposed across the plurality of second contacts.

11. The actuator device according to claim 5, wherein the actuator comprises a plurality of second element contacts as the at least one second element contact, wherein the wire member comprises a plurality of second contacts as the at least one second contact, and wherein the plurality of second contacts are respectively connected to the plurality of second element contacts.

12. The actuator device according to claim 11, wherein the plurality of second contacts comprise a plurality of second wide portions each as the second wide portion, and wherein the plurality of second element contacts comprise portions respectively overlapping the plurality of second wide portions, and the portion of the plurality of second element contacts are joined to each other.

13. The actuator device according to claim 11, wherein a width of each of the plurality of second element contacts in a direction along an edge of the wire member is greater than a width of each of the plurality of second contacts in the direction along the edge of the wire member.

14. The actuator device according to claim 1, wherein the actuator comprises: a plurality of drive elements as the at least one drive element which are arranged in a first direction; and a plurality of first element contacts as the at least one first element contact which are respectively drawn from the plurality of drive elements in a second direction intersecting the first direction and parallel with a surface of the actuator on which the plurality of drive elements are disposed, and wherein the plurality of first element contacts are arranged in the first direction.

15. The actuator device according to claim 1, wherein the wire member is joined to the actuator with a conductive adhesive comprising conductive particles.

16. The actuator device according to claim 15, wherein the first wide portion is covered with the conductive adhesive.

17. The actuator device according to claim 16, wherein a density of the conductive particles is less at a portion of the conductive adhesive which covers the first wide portion than at a portion of the conductive adhesive at which the at least one first element contact and the at least one first contact are connected to each other.

18. The actuator device according to claim 1, wherein the wire member is joined to the actuator with a non-conductive adhesive.

19. The actuator device according to claim 18, wherein the first wide portion is covered with the non-conductive adhesive.

20. The actuator device according to claim 1, wherein the wire member is joined to the actuator with an adhesive, and wherein the first wide portion is covered with an insulating material different from the adhesive.

21. The actuator device according to claim 1, wherein the wire member comprises a base on which the at least one first wire and the at least one first contact are formed, and wherein the base is formed of polyimide.

22. The actuator device according to claim 1, wherein the wire member comprises a drive circuit configured to drive the actuator device, and wherein the at least one first wire is configured to connect the drive circuit and the at least one first contact to each other.

* * * * *